United States Patent [19]

Ikeda et al.

[11] Patent Number: 4,897,343

[45] Date of Patent: Jan. 30, 1990

[54] SILVER HALIDE PHOTOGRAPHIC EMULSION

[75] Inventors: Tadashi Ikeda; Haruo Takei; Shunichi Aida, all of Kanagawa, Japan

[73] Assignee: Fuji Photo Film Co., Ltd., Kanagawa, Japan

[21] Appl. No.: 192,732

[22] Filed: May 11, 1988

[30] Foreign Application Priority Data

May 13, 1987 [JP] Japan ..... 62-114406

[51] Int. Cl.[4] ..... G03C 1/28

[52] U.S. Cl. ..... 430/570; 430/575; 430/599; 430/603; 430/607; 430/608

[58] Field of Search ..... 430/570, 575, 599, 603, 430/607, 608

[56] References Cited

U.S. PATENT DOCUMENTS

| | | | |
|---|---|---|---|
| 3,695,888 | 10/1972 | Hiller et al. | 430/573 |
| 3,809,561 | 5/1974 | Ulbing et al. | 430/573 |
| 4,073,652 | 2/1978 | Floreus | 430/608 |
| 4,585,731 | 4/1986 | Kobayashi et al. | 430/598 |
| 4,636,460 | 1/1987 | Merkl et al. | 430/599 |

*Primary Examiner*—Hoa Van Le

*Attorney, Agent, or Firm*—Sughrue, Mion, Zinn, Macpeak & Seas

[57] ABSTRACT

A spectrally sensitized silver halide photographic emulsion is disclosed, which comprises at least one alkali metal sulfite compound and at least one ascorbic acid compound.

10 Claims, No Drawings

SILVER HALIDE PHOTOGRAPHIC EMULSION

FIELD OF THE INVENTION

This invention relates to a spectrally sensitized silver halide photographic emulsion and, more particularly, to an improvement in decreasing desensitization caused by sensitizing dyes.

BACKGROUND OF THE INVENTION

Spectrally sensitizing is an extremely important and necessary technique in producing light-sensitive materials having high sensitivity and excellent color reproducibility. Spectrally sensitizing dyes function to absorb light rays of a longer wavelength region which silver halide photographic emulsions essentially do not substantially absorb and to transmit the absorbed light energy to the silver halide. Therefore, an increase in the amount of light captured with the aid of a spectrally sensitizing dye is advantageous for enhancing photographic sensitivity. Thus, attempts have been made to raise the amounts of spectrally sensitizing dyes added to silver halide emulsions for increasing the amount of captured light. However, addition of spectrally sensitizing agents to silver halide emulsions in amounts more than the optimal amount rather causes a serious desensitization. This is generally called "dye desensitization" which is the phenomenon that desensitization takes place in the light-sensitive region intrinsic to silver halide in which sensitizing dyes do not substantially show light absorption. A large dye desensitization reduces total sensitivity though some spectrally sensitizing effect is obtained. In other words, sensitivity in the light absorption region (e.g., spectrally sensitized sensitivity) due to the sensitizing dye increases in proportion to the degree of decrease in dye desensitization. Therefore, an important aspect of the spectrally sensitizing technique is decreasing the dye desensitization. In addition, sensitizing dyes whose light-sensitive region is in a longer wavelength region generally cause more dye desensitization. These are described in C. E. K. Mees, *The Theory of the Photographic Process*, pp. 1067 to 1069 (published by McMillan Publishing Co. in 1942).

As techniques for enhancing sensitivity by decreasing dye desensitization, there are known those which are described in Japanese patent application (OPI) Nos. 28916/72, 46738/74, 118236/79 (the term "OPI" as used herein means an "unexamined published application") and U.S. Pat. No. 4,011,083. However, these techniques are still unsatisfactory in that usable sensitizing dyes are limited or in that only insufficient effects are obtained. As the currently most effective techniques for decreasing dye desensitization, there are known those techniques of using bisaminostilbene compounds substituted by pyrimidine derivatives or triazine derivatives in combination which are described in Japanese patent Publication No. 22189/70, Japanese patent application (OPI) Nos. 18726/79, 4822/77, 151026/77, and U.S. Pat. No. 2,945,762. However, the above-described compounds are usually effective for those limited dyes which are of so-called M-band-sensitizing type showing a gently sloping sensitization maximum such as dicarbocyanines, tricarbocyanines, rhodacyanines, and merocyanines and which show a sensitization maximum in a comparatively long wavelength region.

U.S. Pat. No. 3,695,888 discloses that sensitization in the infrared region can be attained by the combination of a specific tricarbocyanine and ascorbic acid, British Pat. No. 1,255,084 discloses that the combined use of a specific complex merocyanine dye and ascorbic acid serves to enchance minus blue sensitivity, British Pat. No. 1,064,193 discloses that the combined use of a specific complex cyanine and ascorbic acid provides an increased sensitivity, and U.S. Pat. No. 3,809,561 discloses the combined use of a desensitizing nucleus-containing cyanine dye and a super-sensitizing dye such as ascorbic acid.

Alkali metal sulfites and ascorbic acid have conventionally been used in silver halide photographic emulsions for various purposes. For example, Japanese patent application (OPI) No. 6024/76 describes the effect of preventing deterioration of color-forming ability of couplers by using the above-described compounds in combination with diffusion-resistant color fog-preventing agents. However, ascorbic acid and the like have been found to cause the sensitizing dyes to be insufficient.

SUMMARY OF THE INVENTION

It is, therefore, an object of the present invention is to provide a more sensitized silver halide photographic emulsion by decreasing dye desensitization.

Another object of the present invention is to provide a silver halide photographic emulsion leaving less color from the sensitizing dyes.

These and other objects of the present invention will become apparent from the following description thereof.

The above-described and other objects of the present invention are attained by incorporating in a spectrally sensitized silver halide photographic emulsion at least one alkali metal sulfite compound and at least one ascorbic acid compound.

DETAILED DESCRIPTION OF THE INVENTION

The sensitizing dyes to be used in the present invention may be either of cyanine dyes and merocyanine dyes, or may be cyanine dyes wherein these two dyes are complexed. Preferable examples thereof are represented by the following formulas (I) or (II):

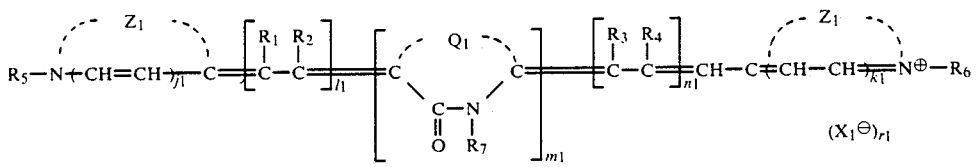

(I)

In the above formula (I), $Z_1$ and $Z_2$, which may be the same or different, each represents atoms forming a 5- or 6-membered, nitrogen-containing hetero ring. Examples of the hetero ring include thiazoline, thiazole benzothiazole, naphthothiazole, selenazoline, selenazole, benzoselenazole, napthoselenazole, oxazole, benzoxazole, naphthoxazole, benzimidazole, naphthoimidazole, pyridine, quinoline, indolenine, imidazo(4,5-b)quinoxaline, benzotellurazole, etc., which may optionally be substituted. Examples of the substituents include a lower alkyl group (containing preferably up to 6 carbon atoms and being optionally further substituted by a hydroxy group, a halogen atom, a phenyl group, a substituted phenyl group, a carboxy group, an alkoxycarbonyl group, an alkoxy group, etc.), a lower alkoxy group (containing preferably up to 6 carbon atoms), an acylamino group (containing preferably up to 8 carbon atoms), a monocyclic aryl group, a carboxy group, a lower alkoxycarbonyl group (containing preferably up to 6 carbon atoms), a hydroxy group, a cyano group, a halogen atom, etc.

When the hetero ring represented by $Z_1$ or $Z_2$ contains another substitutable nitrogen atom such as benzimidazole, napthoimidazole or imidazo(4,5-b)quinoxaline, the another nitrogen atom of the hetero ring may be substituted by, for example, an alkyl or alkenyl group containing up to 6 carbon atoms (which may further be substituted by a hydroxy group, an alkoxy group, a halogen atom, a phenyl group, an alkoxycarbonyl group, etc.).

$Q_1$ represents atoms forming a 5- or 6-membered, nitrogen-containing ketomethylene ring such as thiazolidin-4-one, selenazolidin-4-one, oxazolidin-4-one, imidazolidin-4-one, etc.

$R_1$, $R_2$, $R_3$, and $R_4$ each independently represents a hydrogen atom, a lower alkyl group (containing preferably up to 4 carbon atoms), an optionally substituted phenyl (a substituent therefor includes, e.g., an alkyl group, a halogen atom, and a carboxy group) or aralkyl group (e.g., benzyl group, phenethyl group) or, when $l_1$ represents 2 or 3 when $n_1$ represents 2 or 3, different $R_1$ and $R_1$, Rhd 2 and $R_2$, $R_3$ and $R_3$, or $R_4$ and $R_4$ may be bound to each other to form a 5- or 6-membered ring which optionally contains an oxygen atom, a sulfur atom, a nitrogen atom, etc.

$R_5$, $R_6$, and $R_7$ each independently represents an optionally substituted alkyl or alkenyl group containing up to 10 carbon atoms and optionally containing an oxygen atom, a sulfur atom or a nitrogen atom in the carbon chain. Substituents therefor are exemplified by a sulfo group, a carboxy group, a hydroxy group, a halogen atom, an alkoxycarbonyl group, a carbamoyl group, a phenyl group, a substituted phenyl group, etc.

$l_1$ and $n_1$ each represents 0 or a positive integer of up to 3, with $l_1+n_1$ being up to 3 and, when $l_1$ represents 1, 2, or 3, $R_5$ and $R_1$ may be bound to each other to form a 5- or 6-membered ring.

$j_1$, $k_1$, and $m_1$ each independently represents 0 or 1.

$X_1\ominus$ represents an acid anion, and $r_1$ represents 0 or 1.

At least one of $R_5$, $R_6$, and $R_7$ preferably represents a group containing a sulfo group or a carboxy group.

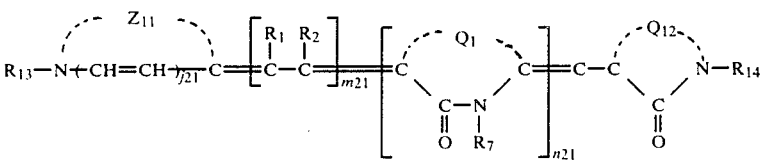

(II)

In the above general formula (II), $Z_{11}$ represents atoms forming a nitrogen-containing, 5- or 6-membered hetero ring. For example, there are illustrated those hetero ring nuclei which are usually used for forming cyanines, such as thiazoline, thiazole, benzothiazole, naphthothiazole, selenazoline, selenazole, benzoselenazole, naphthoselenazole, oxazole, benzoxazole, naphthoxazole, benzimidazole, naphthoimidazole, pyridine, quinoline, pyrrolidine, indolenine, imidazo(4,5-b) quinoxaline, tetrazole, etc. These hetero ring nuclei may be substituted. Examples of the substituents include a lower alkyl group (containing preferably up to 10 carbon atoms and being optionally further substituted by a hydroxy atom, a halogen atom, a phenyl group, a substituted phenyl group, a carboxy group, an alkoxycarbonyl group, and an alkoxy group), a lower alkoxy group (containing preferably up to 7 carbon atoms), an acylamino group (containing preferably up to 8 carbon atoms), a monocyclic aryl group, a monocyclic aryloxy group, a carboxy group, a lower alkoxycarbonyl group (containing preferably up to 7 carbon atoms), a hydroxy group, a cyano group, a halogen atom, etc.

$Q_{11}$ represents atoms forming a nitrogen-containing, 5- or 6-membered ketomethylene ring. For example, there are illustrated atoms forming thiazolidin-4-one, selenazolidin-4-one, oxazolidin-4-one, imidazolidin-4-one, etc.

$Q_{12}$ represents atoms forming a nitrogen-containing, 5- or 6-membered ketomethylene ring. For example, there are illustrated those hetero ring nuclei capable of usually forming merocyanine dyes, such as rhodanine, 2-thiohydantoin, 2-selenathiohydantoin, 2-thiooxazolidine-2,4-dione, 2-selenaoxazolidine-2,4-dione, 2-thiooxazolidine-2,4-dione, 2-selenathiazolidine-2,4-dione, 2-selenaselenazolidine-2,4-dione, etc.

When the hetero ring represented by foregoing $Z_{11}$, $Q_{11}$ or $Q_{12}$ contains two or more nitrogen atoms in the hetero ring-forming atoms such as benzimidazole or thiohydantoin, nitrogen atom or atoms to which $R_{13}$, $R_{15}$ or $R_{14}$ are not bound may have a substituent. Examples of the substituent include an alkyl or alkenyl group containing up to 8 carbon atoms (examples of the alkyl group include, e.g., an acetoxyalkyl group, an alkoxyalkyl gorup, an acylaminoalkyl gorup, an alkoxycarbonylalkyl gorup, a cyanoalkyl group, a hydroxyalkyl group, a hydroxyalkoxyalkyl group, a carbamoylalkyl group, a sulfoalkyl group, etc. and example of the alkenyl group include, e.g., an aryl group, etc.) and optionally having an oxygen atom, a sulfur atom or a nitrogen atom in the alkyl chain and optionally being further substituted, an optionally substituted monocyclic aryl group, etc.

$R_{11}$ represents a hydrogen atom or an alkyl group containing up to 4 carbon atoms, and $R_{12}$ represents a hydrogen atom, an optionally substituted phenyl group (substituents therefor being exemplified by an alkyl or alkoxy group containing up to 4 carbon atoms, a halogen atom, a carboxy group, a hydroxy group, etc.) or an optionally substituted alkyl group (substituents therefor being exemplified by a hydroxy group, a carboxyl group, an alkoxy group, a halogen atom, etc.). When $m_{21}$ represents 2 or 3, different $R_{12}$ and $R_{12}$ may be bound to each other to form a 5- or 6-membered ring optionally containing an oxygen atom, a sulfur atom or a nitrogen atom.

$R_{13}$ represents an alkyl or alkenyl group containing up to 10 carbon atoms and optionally containing an oxygen atom, a sulfur atom or a nitrogen atom in the carbon chain. Examples of the substituents include a sulfo group, a carboxy group, a hydroxy group, a halogen atom, an alkoxycarbonyl group, a carbamoyl group, a phenyl group, a substituted phenyl group or a monocyclic saturated heterocyclic group.

$R_{14}$ and $R_{15}$ are the same as defined for $R_{13}$, or each represents a hydrogen atom or an optionally substituted monocyclic aryl group (substituents therefor being exemplified by a sulfo group, a carboxy group, a hydroxy group, a halogen atom, an alkyl, acylamino or alkoxy group containing up to 5 carbon atoms, etc.).

$m_{21}$ represents 0 or a positive integer of up to 3, $j_{21}$ represents 0 or 1, and $n_{21}$ represents 0 or 1.

When $m_{21}$ represents a positive integer of up to 3, $R_{11}$ and $R_{13}$ may be bound to each other to form a 5- or 6-membered ring.

At least one of $R_{13}$, $R_{14}$, and $R_{15}$ preferably represents a group containing a sulfo or carboxy group.

Specific examples of the compounds to be used in the present invention are illustrated below which, however, are not limitative at all.

Specific examples of the alkali metal sulfite compounds are as follows.

(A-1) Sodium sulfite,
(A-2) Potassium sulfite,
(A-3) Sodium hydrogensulfite,
(A-4) Potassium hydrogensulfite.

Of these, it is preferred to use sodium sulfite or potassium sulfite.

Specific examples of the ascorbic acid compounds are as follows.

(B-1) L-Ascorbic acid,
(B-2) Sodium L-ascorbate,
(B-3) Potassium L-ascorbate,
(B-4) DL-Ascorbic acid,
(B-5) Sodium D-ascorbate,
(B-6) L-Ascorbic acid-6-acetate,
(B-7) L-Ascorbic acid-6-palmitate,
(B-8) L-Ascorbic acid-6-benzoate,
(B-9) L-Ascorbic acid-6-diacetate,
(B-10) L-Ascorbic acid-5,6-O-isopropylidene.

Specific examples of the compound represented by the general formula (I) are as follows.

(I-1)

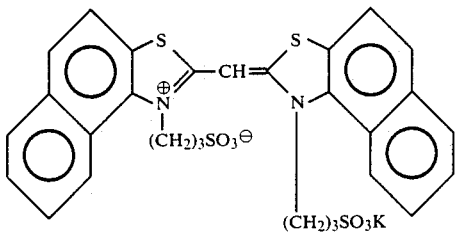

(I-2)

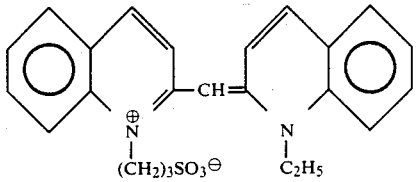

(I-3)

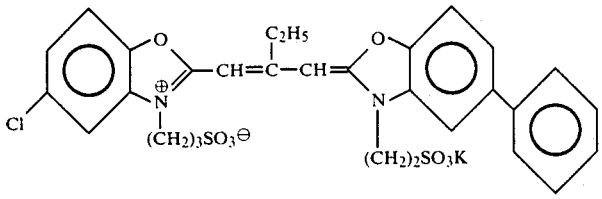

(I-4)

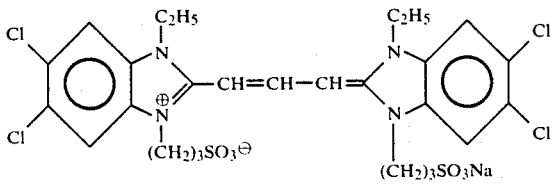

-continued
(I-5)
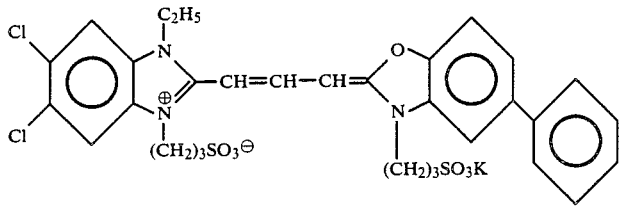
(I-6)
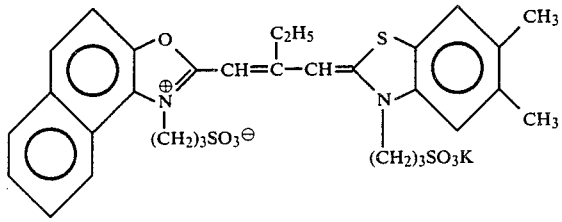
(I-7)
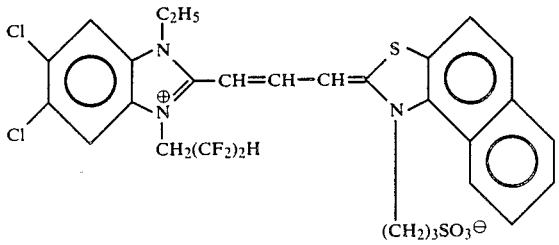
(I-8)
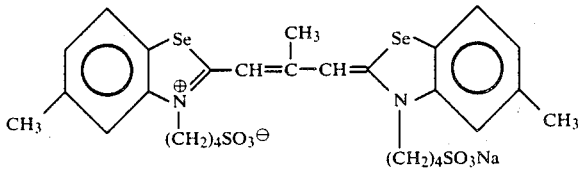
(I-9)
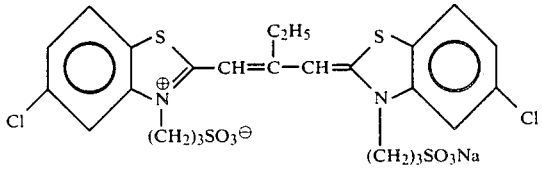
(I-10)
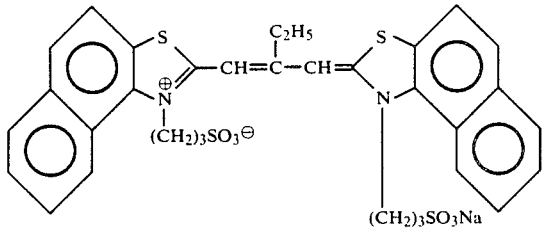
(I-11)
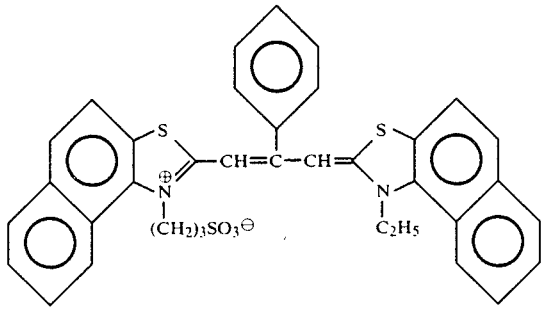

-continued
(I-12)
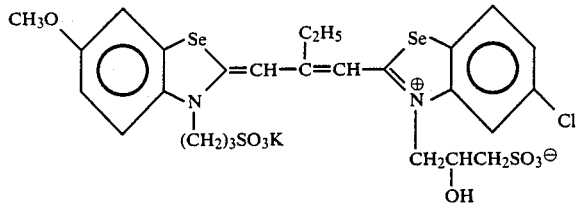
(I-13)
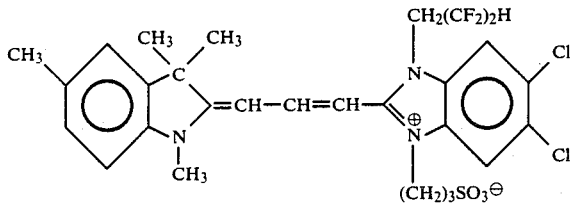
(I-14)
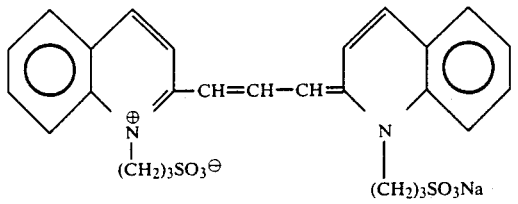
(I-15)
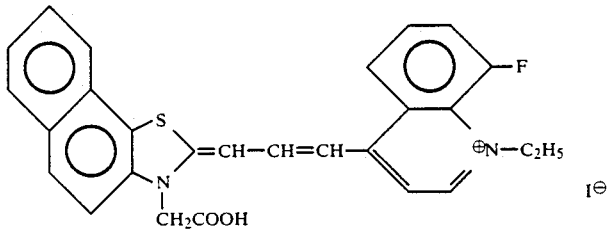
(I-16)
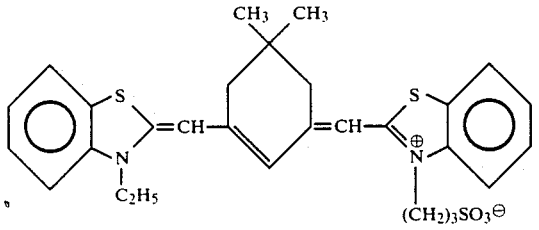
(I-17)
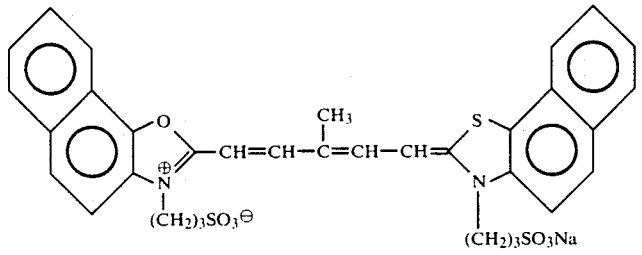

-continued
(I-18)
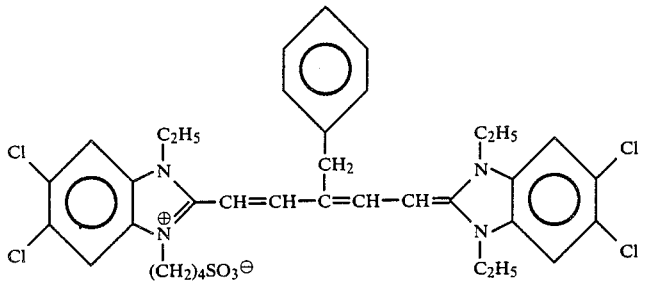
(I-19)
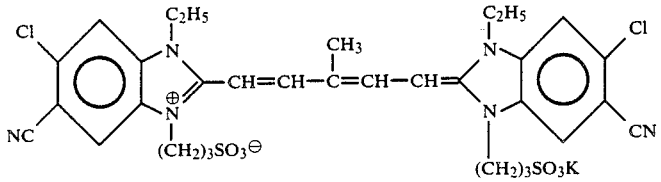
(I-20)
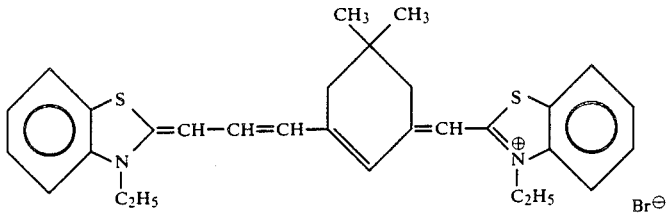
(I-21)
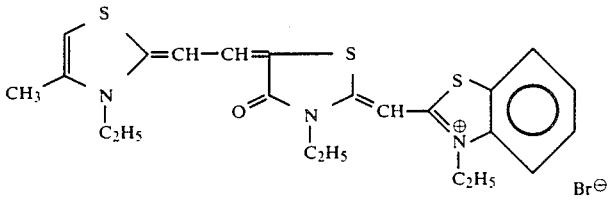
(I-22)
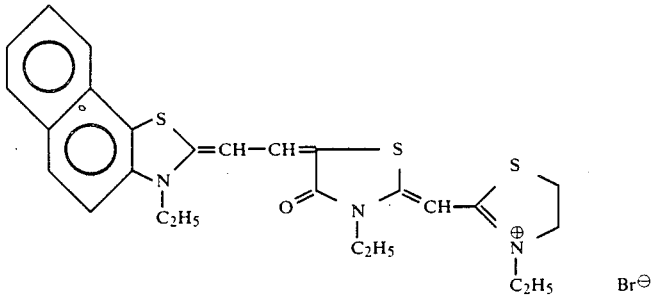
(I-23)
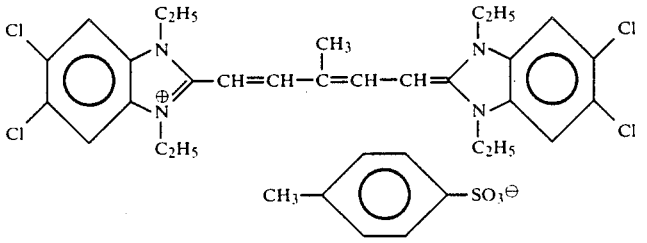

-continued
(I-24)
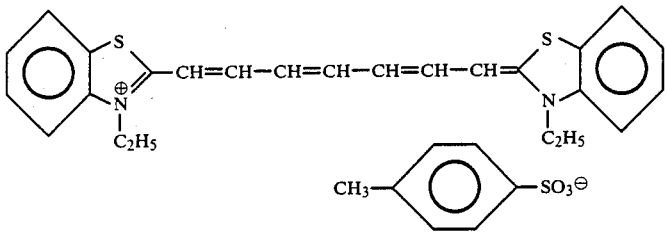
(I-25)
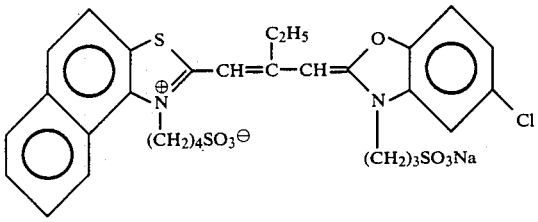
(I-26)
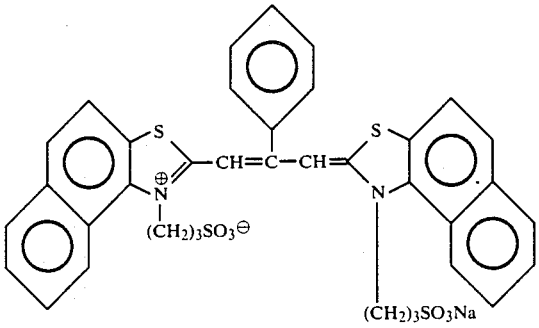
(I-27)
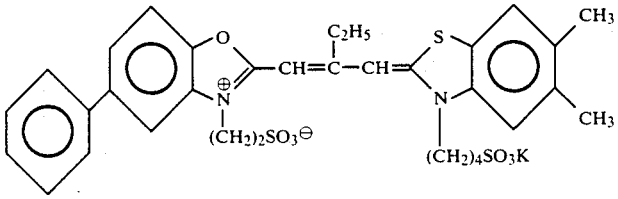
(I-28)
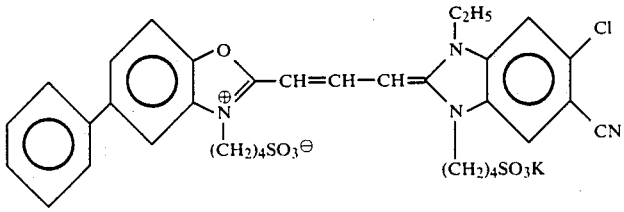
(I-29)
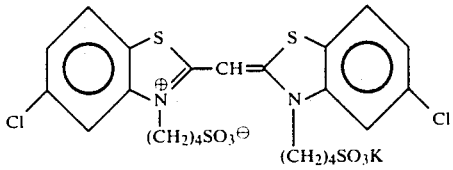

-continued
(I-30)
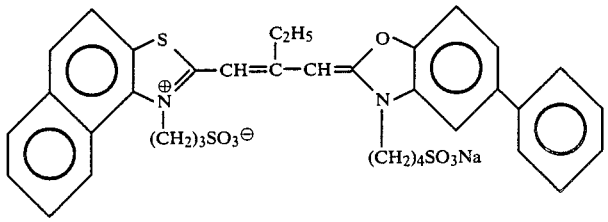
(I-31)
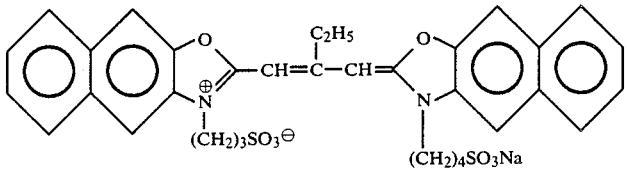
(I-32)
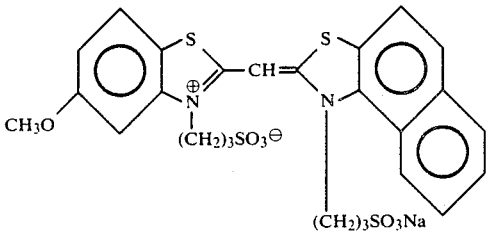
(I-33)
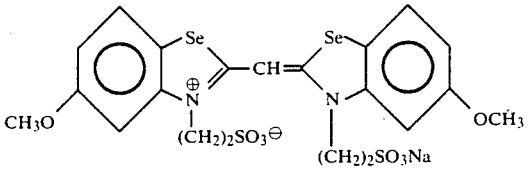
Specific examples of the compound represented by the general formula (II) are as follows.
(II-1)
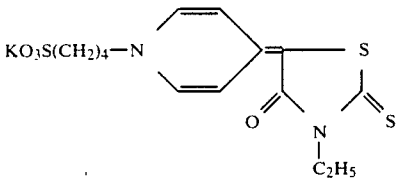
(II-2)
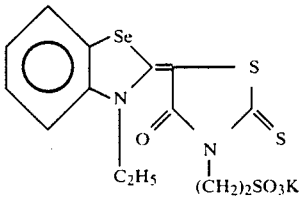

-continued
(II-3)
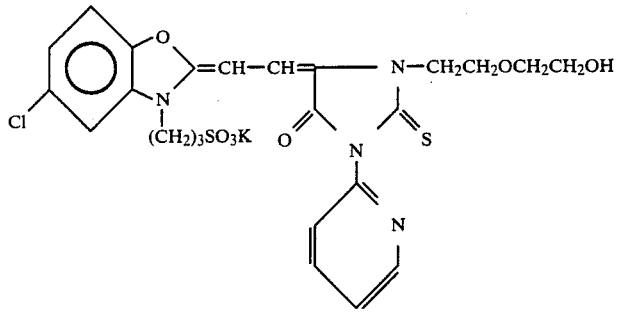
(II-4)
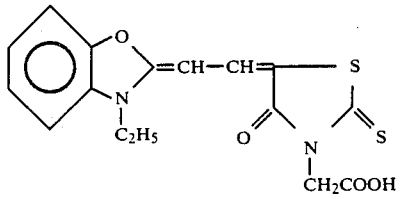
(II-5)
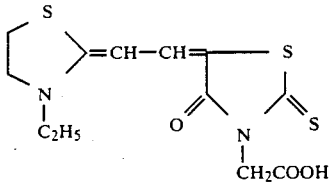
(II-6)
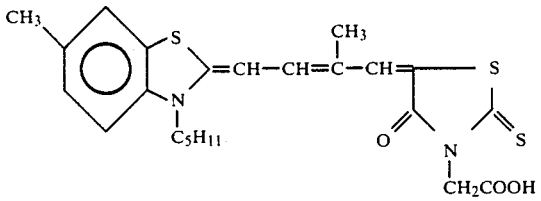
(II-7)
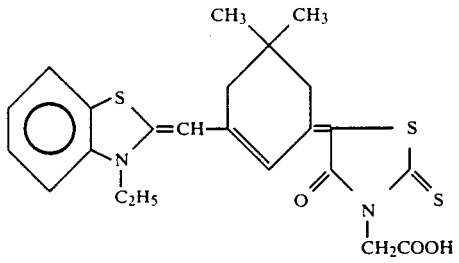
(II-8)
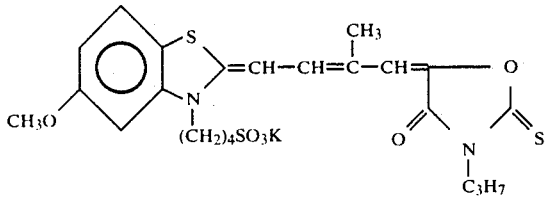

-continued (II-8)

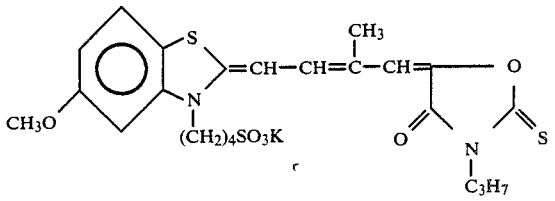

(II-9)

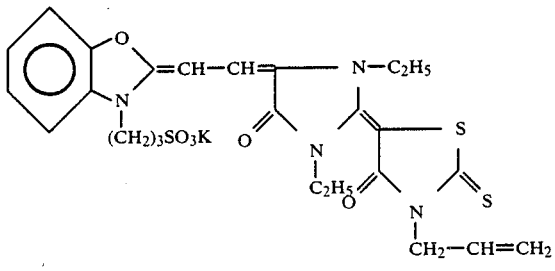

(II-10)

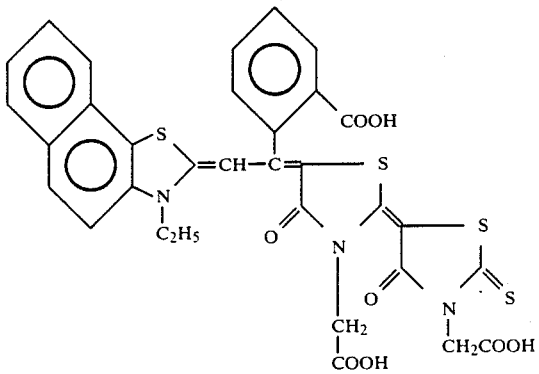

(II-11)

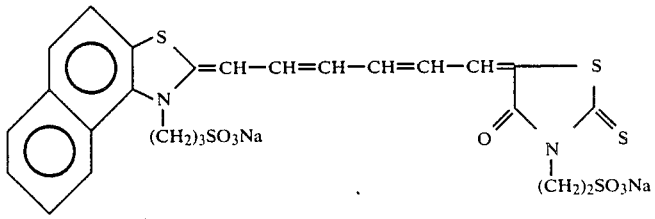

In incorporating the aforesaid alkali metal sulfite compound and the ascorbic acid compound in the silver halide emulsion of the present invention, they may be directly dispersed in the emulsion or may be dissolved in a single solvent or mixed solvent of water, methanol, ethanol, or the like, followed by adding the resulting solution to the emulsion. The aforesaid two compounds may be separately added to the emulsion, but are preferably added as a mixed solution thereof since the mixed solution has more stability. The aforesaid compounds may be allowed to be present in any step in the processing for preparing the photographic emulsion, regardless of whether the step is before or after addition of sensitizing dyes. The alkali metal sulfite compound and the ascorbic acid compound to be used in the present invention are incorporated each in an amount of $1\times10^{-6}$ mol to $5\times10^{-2}$ mol, preferably $1\times10^{-5}$ mol to $2\times10^{-2}$ mol, particularly preferably $1\times10^{-4}$ mol to $1.6\times10^{-2}$ mol, per mol of silver halide. The ratio of the alkali metal sulfite compound to the ascorbic acid compound (by molar ratio) is preferably in the range of from 20:1 to 1:20, more preferably from 10:1 to 1:10. The sum of the alkali metal sulfite compound and the ascorbic acid compound is $2\times10-4$ mol to $4\times10-2$ mol per mol of silver with respect to silver chloride emulsions, silver bromide emulsions, silver chlorobromide emulsions, and silver chloroiodobromide emulsions containing up to 1 mol % iodide. Furthermore, the sum of the alkali metal sulfite compound and the ascorbic acid compound is $2\times10^{-5}$ mol to $4\times10^{-3}$ mol per mol of silver with respect to silver iodobromide emulsions.

The sensitizing dyes to be used in the present invention and represented by the general formulas (I) or (II) are known compounds. For example, the compounds represented by the general formulas (I) or (II) are described in Japanese patent application (OPI) Nos. 126140/76, 139323/76, 14313/76, 35386/80, 109925/77, 135322/78, West German patent application (OLS) No. 2,158,553, Japanese patent Publication No. 2614/77, Japanese patent application (OPI) No. 28916/72, F. M. Hamer, *The Chemistry of Heterocyclic Compounds*, Vol. 18, *The Cyanine Dyes and Related Compounds* (A.

Weissberger ed., Interscience, New York, 1964), D. M. Sturmer, *The Chemistry of Heterocyclic Compounds* Vol. 30 (A. Weissberger and E. C. Taylor ed., John Wiley, New York, 1977), p. 441, and the like, and may be synthesized by reference to these citations.

Incorporation of the compounds represented by the foregoing general formulas (I) or (II) in the silver halide emulsion of the present invention may be conducted by directly dispersing them in the emulsion or by dissolving them in a single or mixed solvent of water, methanol, propanol, methylcellosolve, 2,2,3,3-tetrafluoro-propanol, etc., and adding the resulting solution to the emulsion. In addition, they may be added to the emulsion as an aqueous solution prepared by allowing an acid or a base to coexist as is described in Japanese patent Publication Nos. 23389/69, 27555/69, 22089/82, etc., or as an aqueous solution or a colloidal dispersion prepared by allowing a surfactant to coexist as described in U.S. Pat. Nos. 3,822,135, 4,006,025, etc. Further, the compounds may be first dissolved in a substantially water-immiscible solvent such as phenoxyethanol, then the resulting solution is dispersed in water or a hydrophilic colloid, followed by adding the dispersion to the emulsion. Still further, as is described in Japanese patent application (OPI) Nos. 102733/78 and 105141/83, the compounds may be directly dispersed in a hydrophilic colloid, and the resulting dispersion is added to the emulsion.

The sensitizing dyes to be used in the present invention may be dissolved by applying ultrasonic wave vibration as described in U.S. Pat. No. 3,485,634. Other techniques employable for adding the sensitizing dyes of the present invention by dissolution or dispersion include those which are described in U.S. Pat. Nos. 3,482,981, 3,585,195, 3,469,987, 3,425,835, 3,342,605, British Pat. Nos. 1,271,329, 1,038,029, 1,121,174, U.S. Pat. Nos. 3,660,101 and 3,658,546.

The sensitizing dyes may be present in any step in the process of preparing the photographic emulsion, or may be present in any step after preparation to immediately before coating of the emulsion. Examples of the former include the step of forming silver halide grains, the physical ripening step, the chemical ripening step, etc. For example, the dyes may be added during formation of the grains as described in Japanese patent application (OPI) No. 26589/80.

The sensitizing dyes of the general formula (I) or (II) to be used in the present invention are incorporated in the silver halide photographic emulsion in amounts of from $5\times10^{-7}$ mol to $5\times10^{-3}$ mol, preferably $5\times10^{-6}$ mol to $2\times10^{-3}$ mol, particularly preferably $1\times10^{-5}$ mol to $1\times10^{-3}$ mol, per mol of silver halide.

Dye desensitation is generally caused larger by sensitizing dye whose light-sensitive region is in a longer wavelength region. Thus the effect of the present invention is remarkable by using the sensitizing dye whose light-sensitive region is in a longer wavelength region. The present invention is useful for a sensitizing dye showing dye sensitization. Of the sensitizing dye, a red-sensitive sensitizing dye, especially, a sensitizing dye having a sensitizing maximum wavelength of longer than 600 nm is preferred.

As silver halide to be used in the photographic emulsion of the present invention, any of silver bromide, silver iodobromide, silver iodochlorobromide, silver chlorobromide (particularly, containing up to 1 mol % iodide), and silver chloride may be used.

Silver halide grains are not limited as to crystal phase.

Silver halide emulsions which comprise tabular silver halide grains of not more than 0.5 $\mu$ in thickness, preferably not more than 0.3 $\mu$, and not less than preferably 0.6 $\mu$ in diameter and wherein grains with an aspect ratio of 5 or more accounts for 50% or more of the total projected area are of the grains may be used. In addition, a monodispersed emulsion wherein grains having a grain size within ±40% of the average grain size account for 95% or more in number may also be used.

The silver halide grains to be used in the present invention may have an inner portion and a surface layer different from each other in phase composition, or may wholly comprise a uniform phase. Further, silver halide grains of the type forming latent images mainly on the surface thereof (for example, negative-working emulsions) and grains of the type forming latent images mainly within them (for example, internal latent image-forming type emulsions and previously fogged direct reversal emulsions) may be used.

Photographic emulsions to be used in the present invention can be prepared by the processes described in P. Grafkides, *Chimie et Physique Photographique* (Paul Montel, 1967), G. F. Duffin, *Photographic Emulsion Chemistry* (Focal Press, 1966), V. L. Zelikman et al, *Making and Coating Photographic Emulsion* (Focal Press, 1964), etc.

That is, any of an acidic process, a neutral process and an ammoniacal process can be used. As a manner of reacting a soluble silver salt with a soluble halide salt, any of single-jet method, double-jet method, and a combination of the two may be employed.

A process of forming grains in the presence of excess silver ion (called reverse mixing process) may be employed as well. As one type of the double-jet method, a process called a controlled double jet process wherein the pAg in a liquid phase in which silver halide is formed is kept constant may be employed. This process provides a silver halide emulsion containing silver halide grains of regular crystal form having an approximately uniform particle size.

Two or more silver halide emulsions having been separately prepared may be mixed together for use.

Upon formation of the silver halide grains, silver halide solvents such as ammonia, potassium rhodanede, ammonium rhodanide, thioether compounds (described in, for example, U.S. Pat. Nos. 3,271,157, 3,574,628, 3,704,130, 4,297,439, 4,276,374, etc.), thione compounds (described in, for example, Japanese patent application (OPI) Nos. 144319/78, 82408/78, 77737/80, etc.), amine compounds (described in, for example, Japanese patent application (OPI) No. 100717/79, etc.), etc. may be used.

During formation or physical ripening of the silver halide grains, cadmium salts, zinc salts, thallium salts, iridium salts or complex salts thereof, rhodium salts or complex salts thereof, iron salts or complex salts thereof, etc. may be allowed to coexist.

As the internal latent image-forming type silver halide emulsions to be used in the present invention, there are illustrated, for example, emulsions containing different metals described in U.S. Pat. Nos. 2,592,250, 3,206,313, 3,447,927, 3,761,276, 3,935,014, etc.

The silver halide emulsions are usually chemically sensitized. Chemical sensitization can be conducted according to the processes described in, for example, H, Frieser, *Die Grundlagender Photographischen Prozesse mit Silberhalogeniden* (published by Akademische Verlagsgeselschaft, 1968), pp. 675 to 734.

That is, sulfur sensitization using active gelatin or a sulfur-containing compound capable of reacting with silver ions (e.g., thiosulfates, thioureas, mercapto compounds, rhodanines, etc.); reduction sensitization using a reductive compound (e.g., stannous salts, amines, hydrazine derivatives, formamidinesulfinic acids, silane compounds, etc.); and noble metal sensitization using compounds of noble metals (e.g., complex salts of the group VIII metals in the periodic table such as Pt, Rh, Ir, Pd, etc.) may be employed alone or in combination. Specific chemical sensitizing agents include sulfur sensitizers such as allylthiocarbamide, thiourea, sodium thiosulfate, cystine, etc.; noble metal sensitizers such as potassium chloroaurate, aurous thiosulfate, potassium chloropalladate, etc.; and reductive sensitizers such as tin chloride, phenylhydrazine, reductone, etc. In addition, sensitizers of polyoxyethylene compounds, polyoxypropylene compounds, and compounds having a quaternary ammonium group may also be used.

Various compounds may be incorporated in the photographic emulsion of the present invention for the purpose of preventing formation of fog or stabilizing photographic properties in the steps of producing, or during storage or processing of, light-sensitive materials. That is, many compounds known as antifoggants or stabilizers such as azoles (e.g., benzothiazolium salts, nitroindazoles, triazoles, benzotriazoles, benzimidazoles (particularly, nitro- or halogen-substituted derivatives), etc.; hetero ring-containing mercapto compounds (e.g., mercaptothiazoles, mercaptobenzothiazoles, mercaptobenzimidazoles, mercaptothiadiazoles, mercaptotetrazoles (particularly, 1-phenyl-5-mercaptotetrazole), and mercaptopyrimidines; hetero ring-containing mercapto compounds described above having a water-soluble group such as a carboxyl group or a sulfo group; thioketo compounds (e.g., oxazolinethione); azaindenes (e.g., tetrazaindenes (particularly 4-hydroxy-substituted (1,3,3a,7)-tetrazaindenes); benzenethiosulfonic acids; benzenesulfinic acids; etc. can be used.

The silver halide emulsion of the present invention may contain a polymer latex comprising a homo- or co-polymer of alkyl acrylate, alkyl methacrylate, acrylic acid, glycidyl acrylate, etc. described in U.S. Pat. Nos. 3,411,911, 3,411,912, 3,142,568, 3,325,286, 3,547,650, Japanese patent Publication No. 5331/70, etc. for the purpose of improving dimensional stability and film properties of photographic materials.

In the case of using the silver halide emulsion of the present invention for lith type printing light-sensitive materials, polyalkylene oxide compounds capable of enhancing the effect of infectious development may be used. For example, those compounds which are described in U.S. Pat. Nos. 2,400,532, 3,294,537, 3,294,540, French Pat. Nos. 1,491,805, 1,596,673, Japanese patent Publication No. 23466/65, Japanese patent application (OPI) Nos. 156423/75, 18726/79, and 151933/81 may be used. Preferable examples thereof include a condensate between a polyalkylene oxide composed of at least 10 units of alkylene oxide containing 2 to 4 carbon atoms (e.g., ethylene oxide, propylene-1,2-oxide, butylene-1,2-oxide, etc., preferably ethylene oxide) and a compound having at least one active hydrogen atom (e.g., water, aliphatic alcohol, aromatic alcohol, fatty acid, organic amine, hexitol derivative, etc.); a block polymer of two or more polyalkylene oxides; etc. Specific examples of the usable polyalkylene oxide compounds include polyalkylene glycol, alkyl ethers, polyalkylene glycol aryl ethers, polyalkylene glycol alkylaryl ethers, polyalkylene glycol esters, polyalkylene glycol fatty acid amides, polyalkylene glycol amines, polyalkylene glycol block co-polymers, polyalkylene glycol graft polymers, etc. Usable polyalkylene oxide compounds have a molecular weight of 300 to 15,000, preferably 600 to 8,000.

The amounts of these polyalkylene oxide compounds to be added are preferably 10 mg to 3 g per mol of silver halide. Their addition may be conducted at any stage in the production process.

The silver halide photographic emulsion of the present invention may contain a color coupler such as a cyan coupler, a magenta coupler, and a yellow coupler and a compound capable of dispersing the coupler.

That is, the emulsion may contain a compound capable of forming color by oxidative coupling with an aromatic primary amine developing agent (e.g., a phenylenediamine derivative, an aminophenol derivative, etc.) in color development processing. For example, magenta couplers include 5-pyrazolone couplers, pyrazolobenzimidazole couplers, cyanoacetylcoumarone couplers, open-chain acylacetonitrile couplers, etc., yellow couplers include acylacetamide couplers (e.g., benzoylacetanilides, pivaloylacetanilides, etc.), etc., and cyan couplers include naphthol couplers, phenol couplers, etc. Of these couplers, non-diffusible couplers having a hydrophobic group called a ballast group are desirable. The couplers may be of either 4-equivalent type or 2-equivalent type based on silver ion. Colored couplers having color-correcting effect or couplers capable of releasing a development inhibitor upon development (called DIR couplers) may also be used.

In addition to the DIR couplers, non-color-forming DIR coupling compounds capable of forming a colorless coupling reaction product and releasing a development inhibitor may also be incorporated into the emulsion.

The silver halide photographic emulsion of the present invention may contain a water-soluble dye (e.g., an oxonol dye, a hemioxonol dye, and a merocyanine dye) as a filter dye or for other various purposes.

The photographic emulsion of the present invention may contain various surfactants for various purposes, e.g., as a coating aid, for preventing the generation of static charges, improving emulsion dispersion, preventing adhesion, improving photographic characteristics (e.g., accelerating development, increasing contrast, sensitization, etc.).

For example, nonionic surfactants such as saponin (steroid type), alkylene oxide derivatives (e.g., polyethylene glycol), polyethylene glycol alkyl ethers, glycidol derivatives, aliphatic esters of polyvalent alcohols, alkyl esters of sucrose, etc.; anionic surfactants such as alkylcarboxylates, alkylsulfonates, alkylbenzenesulfonates, alkylsulfates, etc.; and cationic surfactants such as alkylamine salts, aliphatic or aromatic quaternary ammonium salts, heterocyclic quaternary ammonium salts (e.g., pyridinium, imidazolium, etc.); etc. In the case of using the surfactants for preventing generation of static charge, fluorine-containing surfactants are preferable.

In practicing the present invention, the following known discoloration inhibitors can be used. The discoloration inhibitors may be used alone or as a combination of two or more. The known discoloration inhibitors include, for example, hydroquinone derivatives, gallic acid derivatives, p-alkoxyphenols, hinderedphenol derivatives, bisphenols, etc.

The photographic emulsion of the present invention may contain inorganic or organic hardeners. For example, chromium salts (e.g., chromium alum, chromium acetate, etc.), aldehydes (e.g., formaldehyde, glyoxal, glutaraldehyde, etc.), active vinyl compounds (e.g., 1,3,5-triacryloyl-hexahydro-s-triazine, 1,3-vinylsulfonyl-2-propanol, etc.), active halogen compounds (e.g., 2,4-dichloro-6-hydroxyl-s-triazine, etc.), etc. may be used alone or in combination.

The light-sensitive material to be prepared according to the present invention may contain hydroquinone derivatives, aminophenol derivatives, gallic acid derivatives, etc. as color fog-preventing agents.

To the silver halide photographic emulsion of the present invention may be added acylated gelatins (e.g., phthaloylated gelatin, malonoylated gelatin, etc.), cellulose compounds (e.g., hydroxyethylcellulose, carboxymethylcellulose, etc.), etc. as prospective colloids as well as gelatin; soluble starches (e.g., dextrin); hydrophilic polymers (e.g., polyvinly alcohol, polyvinyl pyrrolidone, polyacrylamide, polystyrenesulfonic acid, etc.); plasticizers for improving dimensional stability; latex polymers; and matting agents. The finished emulsion is coated on a proper support such as baryta paper, resin-coated paper, synthetic paper, plastic base (e.g., triacetate film, polyethylene terephthalate film, etc.), or glass plate.

Exposure for obtaining a photographic image may be conducted in an ordinary manner. That is, any of known various light sources such as natural light (sunlight), tungsten lamp, fluorescent lamp, mercury lamp, xenon arc lamp, carbon arc lamp, xenon flash lamp, laser, LED, CRT, etc. may be employed. As to exposure time, not only an exposure time of 1/1000 sec to one second employed for ordinary cameras but an exposure time shorter than 1/1000 second, for example, $1/10^4$ to $1/10^6$ second using a xenon flash lamp or an exposure time longer than one second may be used as well. If necessary, spectral composition of light to be used for the exposure may be adjusted by using a color filter or filters. Laser light may also be used for the exposure. In addition, exposure may be effected by using light emitted from a fluorescent body excited by electron beam, x-rays, $\gamma$-rays, $\alpha$-rays, or the like.

The spectrally sensitizing dyes of the present invention may be used for sensitizing silver halide photographic emulsions for various color or black-and-white light-sensitive materials. Emulsions to be used include, for example, color positive-working emulsions, emulsions for color papers, color negative-working emulsions, color reversal emulsions (containing or not containing couplers), emulsions for plate-making photographic light-sensitive materials (e.g., lith films, etc.), emulsions for light-sensitive materials for CRT display, emulsions for silver salt diffusion transfer process, emulsions for color diffusion transfer process, emulsions for imbitio transfer process (described in U.S. Pat. No. 2,882,156, etc.), emulsions for silver dye-bleach process, emulsions for materials recording print-out image (described in, for example, U.S. Pat. No. 2,369,449), emulsions for direct print image light-sensitive materials (described in, for example, U.S. Pat. Nos. 3,033,682, etc.), and the like.

In photographic processing of light-sensitive materials prepared by employing the present invention, any of known processes and known processing solutions as described in, for example, *Research Disclosure*, Vol. 176, pp. 28 to 30 (RD-17643) may be used. This processing may be a photographic processing of forming a silver image (black-and-white photographic processing) or a photographic processing of forming a dye image (color photographic processing) depending upon the end-use. The processing temperature is usually selected between 18° C. and 50° C., but temperatures lower than 18° C. or higher than 50° C. may also be employed.

The present invention is now illustrated in greater detail by reference to the following examples which, however, are not to be construed as limited the present invention in any way.

Unless otherwise specified, all percents, ratios, etc. are by weight.

EXAMPLE 1

A sulfur-sensitized silver halide emulsion comprising 70 mol % of silver chloride, 29.5 mol % of silver bromide, and 0.5 mol % of silver iodide was prepared. Silver halide grains therein had an average diameter of 0.35 $\mu$. This emulsion contained 1.03 mol of silver halide per kg.

1 kg portions of this emulsion were weighed out in pots, sensitizing dyes were added thereto as shown in Tables 1 to 7, then an alkali metal sulfite compound and an ascorbic acid compound were added thereto, followed by stirring at 40° C. Further, 0.2 g/kg emulsion of 4-hydroxy-6-methyl-1,3,3a,7-tetrazaindene, 0.1 g/kg emulsion of 2,4-dichloro-6-hydroxy-1,3,5-triazine sodium salt, and 0.1 g/kg emulsion of sodium dodecylbenzenesulfonate were added thereto in sequence. Each of the thus-obtained emulsions was coated on a polyethylene terephthalate film base to obtain photographic light-sensitive materials.

Each of these samples was exposed for 5 seconds to a tungsten light (2854° K.) through a blue filter (bandpass filter transmitting light of 395 nm to 440 nm) or a red filter (transmitting light of longer than 600 nm).

After exposure, the samples were developed at 20° C. for 2 minutes using a developer of the following formulation. Densities of the thus-developed film samples were measured by means of a densitometer made by Fuji Photo Film Co., Ltd. to determine red filter sensitivity (SR), blue filter sensitivity (SB), and fog. The standard point for determining the optical density was a point of (fog + 1.5) in density.

| | |
|---|---|
| Water | 700 ml |
| Metol | 3.1 g |
| Anhydrous sodium sulfite | 45 g |
| Hydroquinone | 12 g |
| Sodium carbonate (monohydrate) | 79 g |
| Potassium bromide | 1.9 g |
| Water to make | 1 liter |

Upon use, two times of water was added to this formulation.

Results thus obtained are presented in Tables 1 to 7 as relative values.

TABLE 1

| Test No. | Sensitizing Dye and Its Amount ($\times 10^{-4}$ mol/kg emulsion) | | Alkali Metal Sulfite Compound and Its Amount ($\times 10^{-2}$ mol/kg emulsion) | | Ascorbic Acid Compound and Its Amount ($\times 10^{-2}$ mol/kg emulsion) | | SR | SB | Fog | Remarks |
|---|---|---|---|---|---|---|---|---|---|---|
| 1 | | — | | — | | — | — | 100 | 0.03 | Comparison |
| 2 | (I-23) | 0.8 | | — | | — | 100 | 32 | 0.04 | " |
| 3 | " | 1.6 | | — | | — | 105 | 18 | 0.08 | " |
| 4 | " | 3.2 | | — | | — | 110 | 14 | 0.33 | " |
| 5 | " | 1.6 | (A-1) | 0.16 | | — | 200 | 28 | 0.73 | " |
| 6 | " | 1.6 | " | 1.6 | | — | Impossible to measure due to serious fog | | | " |
| 7 | " | 1.6 | | — | (B-1) | 0.16 | 390 | 47 | 0.20 | " |
| 8 | " | 1.6 | | — | " | 0.42 | 468 | 49 | 0.58 | " |
| 9 | " | 1.6 | | — | " | 1.6 | Impossible to measuredue to serious fog | | 2.51 | " |
| 10 | (I-23) | 1.6 | (A-1) | 0.16 | (B-1) | 0.016 | 340 | 40 | 0.04 | Invention |
| 11 | " | 1.6 | " | 0.16 | " | 0.042 | 355 | 42 | 0.04 | " |
| 12 | " | 1.6 | " | 0.16 | " | 0.16 | 355 | 40 | 0.04 | " |
| 13 | (I-23) | 1.6 | (A-1) | 1.6 | (B-1) | 0.16 | 575 | 60 | 0.04 | " |
| 14 | " | 1.6 | " | 1.6 | " | 0.42 | 575 | 60 | 0.05 | " |
| 15 | " | 1.6 | " | 1.6 | " | 1.6 | 603 | 65 | 0.08 | " |
| 16 | | — | (A-1) | 0.16 | | — | — | 100 | 0.03 | Comparison |
| 17 | | — | " | 1.6 | | — | — | 107 | 0.03 | " |
| 18 | | — | | — | (B-1) | 0.16 | — | 100 | 0.03 | " |
| 19 | | — | | — | " | 1.6 | — | 100 | 0.03 | " |
| 20 | | — | (A-1) | 0.16 | (B-1) | 0.16 | — | 96 | 0.03 | " |
| 21 | | — | " | 1.6 | " | 1.6 | — | 107 | 0.03 | " |

TABLE 2

| Test No. | Sensitizing Dye and Its Amount ($\times 10^{-4}$ mol/kg emulsion) | | Alkali Metal Sulfite Compound and Its Amount ($\times 10^{-2}$ mol/kg emulsion) | | Ascorbic Acid Compound and Its Amount ($\times 10^{-2}$ mol/kg emulsion) | | SR | SB | Fog | Remarks |
|---|---|---|---|---|---|---|---|---|---|---|
| 22 | (I-21) | 3.2 | | — | | — | 100 | 69 | 0.05 | Comparison |
| 23 | " | 3.2 | (A-1) | 1.6 | (B-2) | 0.16 | 155 | 102 | 0.05 | Invention |
| 24 | " | 3.2 | " | 1.6 | " | 0.48 | 155 | 102 | 0.05 | " |
| 25 | " | 3.2 | " | 1.6 | " | 1.6 | 162 | 107 | 0.06 | " |

TABLE 3

| Test No. | Sensitizing Dye and Its Amount ($\times 10^{-4}$ mol/kg emulsion) | | Alkali Metal Sulfite Compound and Its Amount ($\times 10^{-2}$ mol/kg emulsion) | | Ascorbic Acid Compound and Its Amount ($\times 10^{-2}$ mol/kg emulsion) | | SR | SB | Fog | Remarks |
|---|---|---|---|---|---|---|---|---|---|---|
| 26 | (I-10) | 6.4 | | — | | — | 100 | 85 | 0.08 | Comparison |
| 27 | " | 6.4 | (A-1) | 0.16 | (B-1) | 0.016 | 118 | 98 | 0.08 | Invention |
| 28 | " | 6.4 | " | 0.16 | " | 0.048 | 118 | 98 | 0.08 | " |
| 29 | " | 6.4 | " | 0.16 | " | 0.16 | 132 | 100 | 0.08 | " |

TABLE 4

| Test No. | Sensitizing Dye and Its Amount ($\times 10^{-4}$ mol/kg emulsion) | | Alkali Metal Sulfite Compound and Its Amount ($\times 10^{-2}$ mol/kg emulsion) | | Ascorbic Acid Compound and Its Amount ($\times 10^{-2}$ mol/kg emulsion) | | SR | SB | Fog | Remarks |
|---|---|---|---|---|---|---|---|---|---|---|
| 30 | (I-17) | 1.6 | | — | | — | 100 | 73 | 0.05 | Comparison |
| 31 | " | 1.6 | (A-2) | 1.6 | (B-3) | 0.16 | 132 | 98 | 0.05 | Invention |
| 32 | " | 1.6 | " | 1.6 | " | 0.48 | 132 | 98 | 0.05 | " |
| 33 | " | 1.6 | " | 1.6 | " | 1.6 | 135 | 100 | 0.05 | " |

TABLE 5

| Test No. | Sensitizing Dye and Its Amount ($\times 10^{-4}$ mol/kg emulsion) | | Alkali Metal Sulfite Compound and Its Amount ($\times 10^{-2}$ mol/kg emulsion) | | Ascorbic Acid Compound and Its Amount ($\times 10^{-2}$ mol/kg emulsion) | | SR | SB | Fog | Remarks |
|---|---|---|---|---|---|---|---|---|---|---|
| 34 | (I-24) | 0.4 | | — | | — | 100 | 19 | 0.05 | Comparison |
| 35 | " | 0.4 | (A-2) | 0.16 | (B-1) | 0.16 | 195 | 36 | 0.04 | Invention |
| 36 | " | 0.4 | " | 0.48 | " | 0.48 | 224 | 40 | 0.04 | " |

TABLE 5-continued

| Test No. | Sensitizing Dye and Its Amount ($\times 10^{-4}$ mol/kg emulsion) | | Alkali Metal Sulfite Compound and Its Amount ($\times 10^{-2}$ mol/kg emulsion) | | Ascorbic Acid Compound and Its Amount ($\times 10^{-2}$ mol/kg emulsion) | | SR | SB | Fog | Remarks |
|---|---|---|---|---|---|---|---|---|---|---|
| 37 | " | 0.4 | " | 1.6 | " | 1.6 | 257 | 46 | 0.03 | " |

TABLE 6

| Test No. | Sensitizing Dye and Its Amount ($\times 10^{-4}$ mol/kg emulsion) | | Alkali Metal Sulfite Compound and Its Amount ($\times 10^{-2}$ mol/kg emulsion) | | Ascorbic Acid Compound and Its Amount ($\times 10^{-2}$ mol/kg emulsion) | | SR | SB | Fog | Remarks |
|---|---|---|---|---|---|---|---|---|---|---|
| 38 | (II-11) | 0.8 | | — | | — | 100 | 17 | 0.05 | Comparison |
| 39 | " | 0.8 | (A-1) | 1.6 | | — | 331 | 50 | 0.18 | " |
| 40 | " | 0.8 | | — | (B-1) | 1.6 | 145 | 17 | 0.04 | " |
| 41 | " | 0.8 | (A-1) | 0.16 | " | 0.16 | 234 | 23 | 0.04 | Invention |
| 42 | " | 0.8 | " | 0.48 | " | 0.48 | 316 | 37 | 0.04 | " |
| 43 | " | 0.8 | " | 1.6 | " | 1.6 | 416 | 54 | 0.04 | " |

TABLE 7

| Test No. | Sensitizing Dye and Its Amount ($\times 10^{-4}$ mol/kg emulsion) | | Comparative Compound and Its Amount ($\times 10^{-4}$ mol/kg emulsion) | | SR | SB | Fog | Remarks |
|---|---|---|---|---|---|---|---|---|
| 44 | (II-11) | 0.8 | | — | 100 | 17 | 0.05 | Comparison |
| 45 | " | 0.8 | (X) | 1.6 | 229 | 30 | 0.06 | " |
| 46 | " | 0.8 | " | 3.2 | 234 | 33 | 0.06 | " |
| 47 | " | 0.8 | " | 6.4 | 240 | 29 | 0.07 | " |

Table 1 shows that sensitizing dye (I-23) causes serious dye desensitization (decrease in SB) when used in an amount of $1.6\times10^{-4}$ mol/kg emulsion. Addition of sodium sulfite (A-1) serves to improve sensitivity to some extent but, at the same time, it causes a serious increase in fog. Addition of L-ascorbic acid (B-1) alone (Test Nos. 7, 8, and 9) also causes improvement of sensitivity and increase in fog. On the other hand, samples wherein sodium sulfite (A-1) and L-ascorbic acid (B-1) are used in combination (Test Nos. 10 and 15) suffered no increase in fog and, surprisingly, fog is rather depressed when (A-1) and (B-1) are used in certain amounts. As to decrease in dye desensitization, the combined use thereof gives better results than independent use thereof. The above-described effect is obtained by the copresence of both sodium sulfite and L-ascorbic acid with the sensitizing dye and, in silver halide photographic emulsions containing no sensitizing dyes (Test Nos. 16 to 21), the combination of the two compounds exhibits almost no influences. Of the above-described facts, the fact that (A-1) and (B-1) which cause serious fog when separately used together with the sensitizing dye but cause no fog when used as a combination is based on an unexplained phenomenon.

Comparative compound (X) given in Table 7 is one of the at present supposedly most effective compounds capable of depressing dye desensitization, and is described in Japanese Patent Publication No. 22189/70. On the other hand, Table 6 comparatively shows the effect of the present invention of depressing dye desensitization and that of the aforesaid comparative dye using the same sensitizing dye. It can be seen from this that the advantage of the present invention is better than that of the prior art.

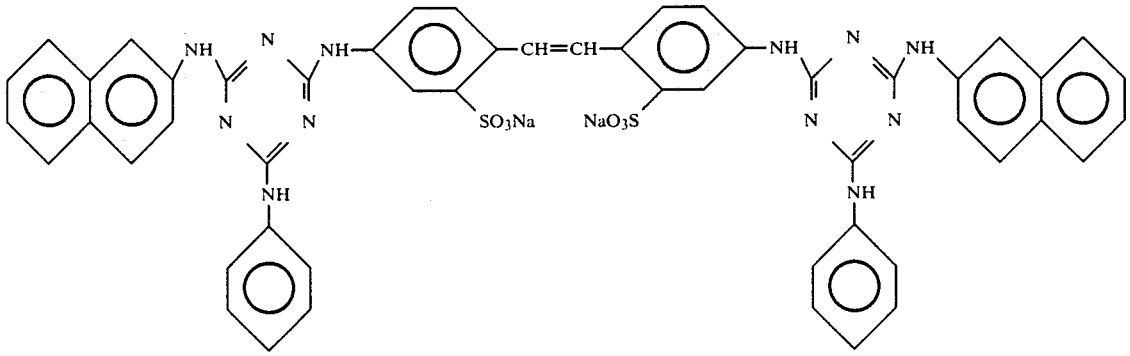

EXAMPLE 2

A gold- and sulfur-sensitized silver halide emulsion comprising 9.15 mol % of silver bromide and 8.5 mol % of silver iodide was prepared. Silver halide grains therein had an average diameter of 0.7 μ. 0.5 mol of silver halide was contained per kg of the emulsion. 1 kg portions of this emulsion were weighed out in pots, sensitizing dyes were added thereto as shown in Table 2-1 to 2-3, and an alkali metal sulfite compound and an ascorbic acid compound were subsequently added thereto, followed by stirring the mixtures at 40° C. Further, 0.1 g/kg emulsion of 4-hydroxy-6-methyl-1,3,3a, 7-tetrazaindene, 0.1 g/kg emulsion of 2,4-dichloro-6-hydroxy-1,3,5-triazine sodium salt, and 0.1 g/kg emulsion of sodium dodecylbenzenesulfonate were added thereto in sequence. Each of the thus obtained emulsions was coated on a polyethylene terephthalate film base to obtain photographic light-sensitive materials.

Each of these samples was exposed for 1/20 second to a tungsten light (2854° K.) using the same filters as used in Example 1. After exposure, they were developed at 20° C. for 7 minutes using a developer of the following formulation. Densities of the thus developed film samples were measured to obtain red filter sensitivity (SR), blue filter sensitivity (SB), and fog. The standard point for determining the optical density was a point of (fog+0.2) in density.

| Formulation of the developer: | |
|---|---|
| Water | 600 ml |
| Metol | 2 g |
| Anhydrous sodium sulfite | 100 g |
| Hydroquinone | 5 g |
| Borax (pentahydrate) | 1.5 g |
| Water to make | 1 liter |

The results thus obtained are presented in Tables 2-1 to 2-3 as relative values.

It is seen that, with silver iodobromide emulsion too, the combined use of the alkali metal sulfite compound and the ascorbic acid compound serves to decrease dye desensitization.

TABLE 2-1

| Test No. | Sensitizing Dye and Its Amount ($\times 10^{-4}$ mol/kg emulsion) | Alkali Metal Sulfite Compound and Its Amount ($\times 10^{-3}$ mol/kg emulsion) | Ascorbic Acid Compound and Its Amount ($\times 10^{-3}$ mol/kg emulsion) | SR | SB | Fog | Remarks |
|---|---|---|---|---|---|---|---|
| 2-1 | — | — | — | — | 100 | 0.04 | Comparison |
| 2-2 | (II-10) 1.6 | — | — | 100 | 91 | 0.05 | " |
| 2-3 | (II-10) 1.6 | (A-1) 0.16 | (B-2) 0.16 | 120 | 96 | 0.05 | Invention |
| 2-4 | (II-10) 1.6 | (A-1) 1.6 | (B-2) 1.6 | 123 | 98 | 0.05 | " |

TABLE 2-2

| Test No. | Sensitizing Dye and Its Amount ($\times 10^{-4}$ mol/kg emulsion) | Alkali Metal Sulfite Compound and Its Amount ($\times 10^{-3}$ mol/kg emulsion) | Ascorbic Acid Compound and Its Amount ($\times 10^{-3}$ mol/kg emulsion) | SR | SB | Fog | Remarks |
|---|---|---|---|---|---|---|---|
| 2-5 | (II-7) 0.4 | — | — | 100 | 25 | 0.09 | Comparison |
| 2-6 | (II-7) 0.4 | (A-3) 0.16 | (B-3) 0.16 | 215 | 63 | 0.09 | Invention |
| 2-7 | (II-7) 0.4 | (A-3) 0.8 | (B-3) 0.8 | 224 | 56 | 0.09 | " |

TABLE 2-3

| Test No. | Sensitizing Dye and Its Amount ($\times 10^{-4}$ mol/kg emulsion) | Alkali Metal Sulfite Compound and Its Amount ($\times 10^{-3}$ mol/kg emulsion) | Ascorbic Acid Compound and Its Amount ($\times 10^{-3}$ mol/kg emulsion) | SR | SB | Fog | Remarks |
|---|---|---|---|---|---|---|---|
| 2-8 | (I-9) 1.6 | — | — | 100 | 93 | 0.05 | Comparison |
| 2-9 | (I-9) 1.6 | (A-1) 0.16 | (B-3) 0.16 | 123 | 100 | 0.05 | Invention |
| 2-10 | (I-9) 0.6 | (A-1) 1.6 | (B-3) 1.6 | 118 | 100 | 0.04 | " |

EXAMPLE 3

Silver halide emulsion (1) to be used in this Example of the present invention was prepared as follows.

| | |
|---|---|
| (Solution 1) | |
| $H_2O$ | 1000 cc |
| NaCl | 15.5 g |
| Gelatin | 32 g |
| (Solution 2) | |
| Sulfuric acid (1N) | 24 cc |
| (Solution 3) | |
| Silver halide solvent of the following structure (1%): | 3 cc |

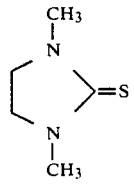

| | |
|---|---|
| (Solution 4) | |
| KBr | 15.66 g |
| NaCl | 3.30 g |
| $H_2O$ to make | 200 cc |
| (Solution 5) | |
| $AgNO_3$ | 32 g |
| $H_2O$ to make | 200 cc |
| (Solution 6) | |
| KBr | 62.72 g |
| NaCl | 13.22 g |
| $K_2IrCl_6$ (0.001%) | 4.54 cc |
| $H_2O$ to make | 600 cc |
| (Solution 7) | |
| $AgNO_3$ | 128 g |

-continued

| | |
|---|---|
| $H_2O$ to make | 600 cc |

(Solution 1) was heated to 56° C., and (Solution 2) and (Solution 3) were added thereto. Then, (Solution 4) and (Solution 5) were simultaneously added thereto in 30 minutes. Ten minutes after the addition, (Solution 6) and (Solution 7) were simultaneously added thereto in 20 minutes. 5 Minutes after the addition, the temperature of the mixture was lowered to desalt. Water and dispersed gelatin were added thereto to adjust pH to 6.2. Thus, a monodispersed cubic silver chlorobromide emulsion of 0.45 μm in average grain size and 70 mol % in silver bromide content was obtained. To this emulsion were added $1.0\times10^{-4}$ mol/mol Ag of chloroauric acid and, further, sodium thiosulfate to conduct optimal chemical sensitization.

To this emulsion was added sensitizing dye (II-6) in an amount of $8.0\times10^{-5}$ mol/mol AgX and, subsequently, sodium sulfite (A-1) and L-ascorbic acid (B-1) were added thereto in amounts of $0.8\times10^{-2}$ mol/mol AgX and, $0.8\times10^{-2}$ mol/mol AgX, respectively, followed by stirring to mix. This emulsion was kept at 40° C. for 30 minutes, then a varying coupler shown in Table 3-1 was added thereto, and the resulting mixture was stirred to prepare coating samples. For comparison, samples not containing (A-1) and (B-1) were also prepared. Each of these samples was coated on a polyethylene-double laminated paper support in the following manner.

The amount of the coating solution was selected so that the amounts of silver and gelatin became 0.35 g/m$^2$ and 1.5 g/m$^2$, respectively, and a protective layer composed of 1.5 g/m$^2$ of gelatin was provided as an upper layer. Two kinds of coated samples were prepared as to gelatin hardener using 2,4-dichloro-6-hydroxy-1,3,5-triazine sodium salt and 1,3-bis(vinylsulfonyl)-2-propanol.

These samples were exposed for 0.5 second to a tungsten light (3,200° K.) using the same red filter as used in Example 1. Thereafter, they were processed using the following color developer.

| Formulation of color developer: | |
|---|---|
| Water | 800 ml |
| Pentasodium diethylenetriaminepenta-acetate | 2.0 g |
| Benzyl alcohol | 15 ml |
| Diethylene glycol | 10 ml |
| $Na_2SO_3$ | 2.0 g |
| KBr | 1.0 g |
| Hydroxylamine sulfate | 3.0 g |
| 4-Amino-3-methyl-N—ethyl-N—(β-(methane-sulfonamido)ethyl)-p-phenylenediamine sulfate | 5.0 g |
| $Na_2CO_3$ (monohydrate) | 30.0 g |
| Fluorescent brightening agent (stilbene type) | 1.0 g |
| Water to make | 1000 ml (pH 10.2) |

-continued

| Formulation of bleach-fixing solution: | |
|---|---|
| Ammonium thiosulfate (54 wt %) | 150 ml |
| $Na_2SO_3$ | 15 g |
| $NH_4$(Fe(III)(EDTA)) | 55 g |
| Disodium EDTA | 4 g |
| Glacial acetic acid | 8.61 g |
| Water to make | 1000 ml (pH 5.4) |

| Formulation of rinsing solution: | |
|---|---|
| EDTA.2Na.$2H_2O$ | 0.4 g |
| Water to make | 1000 ml (pH 7.0) |

Processing conditions were as follows.

| (Processing step) | (Temp.) | (Time) |
|---|---|---|
| Development | 33° C. | 3'30" |
| Bleach-fixing | 33° C. | 1'30" |
| Rising | 28–35° C. | 1'30" |

Photographic properties evaluated are presented as relative sensitivities taking the sensitivity of the sample not containing sodium sulfite (A-1) or L-ascorbic acid (B-1) as 100. The standard point for determining the optical density was a point of (fog+0.5) in density.

TABLE 3-1

| Test No. | Coupler and Coated Amount thereof (g/m$^2$) | Relative Sensitivity | Fog | |
|---|---|---|---|---|
| 3-1 | (C-1) 0.3 | 155 | 0.12 | magenta coupler |
| 3-2 | (C-2) 0.3 | 148 | 0.14 | magenta coupler |
| 3-3 | (C-3) 0.3 | 155 | 0.13 | magenta coupler |
| 3-4 | (C-4) 0.3 | 151 | 0.15 | magenta coupler |
| 3-5 | (C-5) 0.3 | 148 | 0.09 | Cyan coupler |
| 3-6 | (C-6) 0.3 | 145 | 0.08 | Cyan coupler |
| 3-7 | (C-7) 0.3 | 145 | 0.09 | Cyan coupler |
| 3-8 | (C-8) 0.7 | 158 | 0.12 | yellow coupler |

Table 3-1 above shows the results with samples using, 1,3-bis(vinylsulfonyl)-2-propanol as a gelatin hardener. Almost the same results were obtained with samples using another gelatin hardener of 2,4-dichloro-6-hydroxy-1,3,5-triazine sodium salt. As is apparent from the above table, combined use of sodium sulfite and L-ascorbic acid serves to enhance sensitivity. It is also seen that almost the same advantage can be obtained with different couplers.

Chemical structure of couplers used:
(C-1)
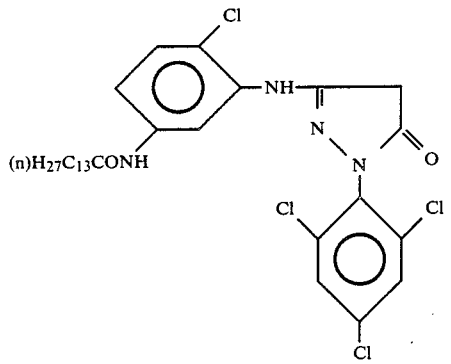
(C-2)
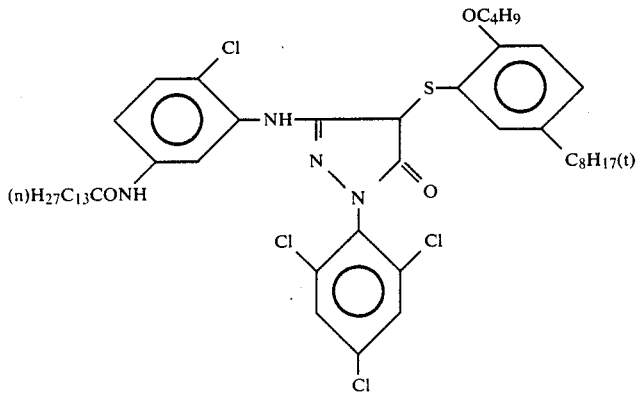
(C-3)
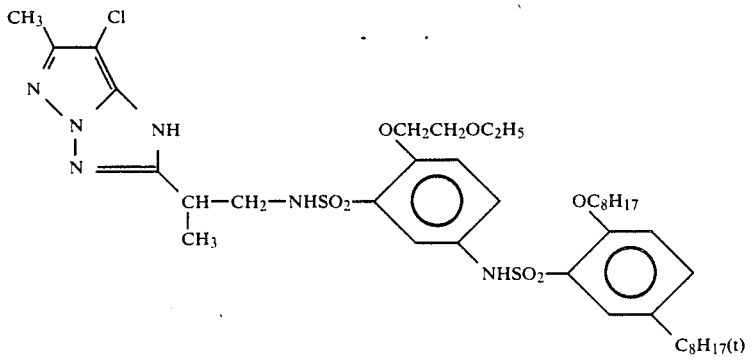
(C-4)
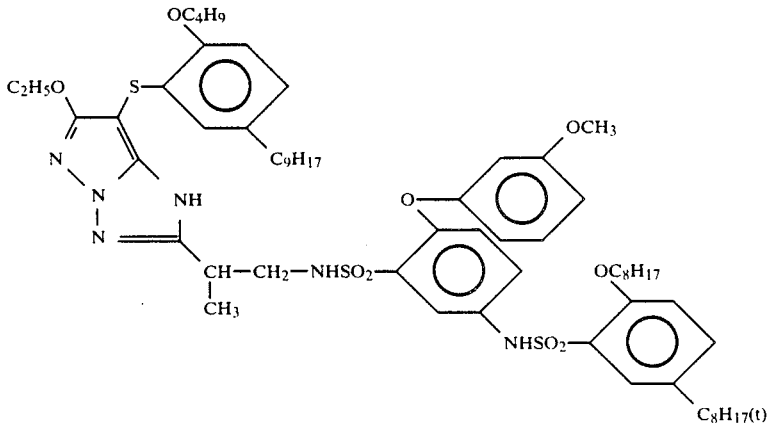

-continued

Chemical structure of couplers used:

(C-5)

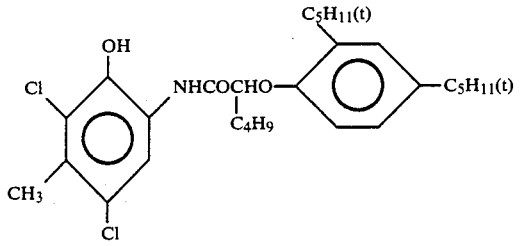

(C-6)

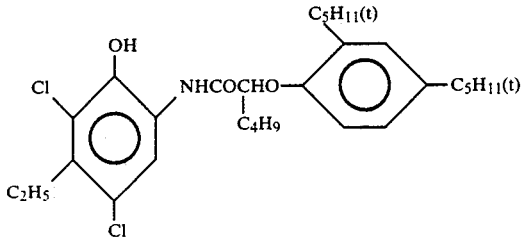

(C-7)

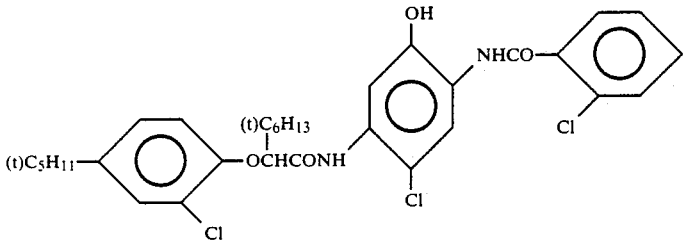

(C-8)

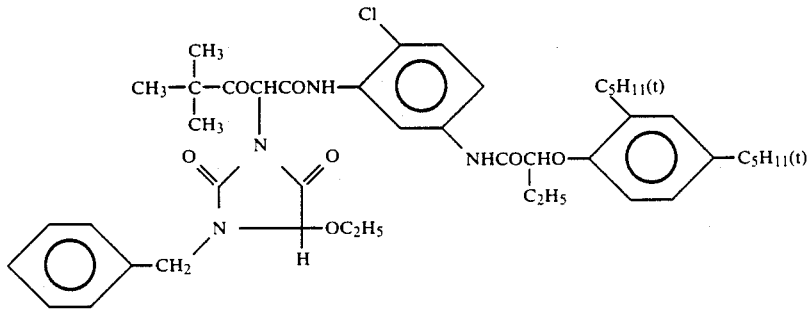

EXAMPLE 4

On a subbed cellulose triacetate film support were multi-coated layers of the following formulations to prepare a multi-layer color light-sensitive material, Sample 101.

(Formulation of light-sensitive layer)

Numerical values corresponding to respective components present coated amounts in terms of g/m$^2$. With silver halide and colloidal silver, numerical values present the amounts of coated silver and, with sensitizing dyes, numerical values present the amounts of coated dyes per mol of silver halide contained in the same layer.

(Sample 101)

| | |
|---|---|
| 1st layer: Antihalation layer | |
| Black colloidal silver | 0.18 (silver) |
| Gelatin | 0.40 |
| 2nd layer: Interlayer | |

-continued

| | |
|---|---|
| 2,5-di-t-pentadecylhydroquinone | 0.18 |
| EX-1 | 0.07 |
| EX-3 | 0.02 |
| U-1 | 0.08 |
| U-2 | 0.08 |
| HBS-1 | 0.10 |
| HBS-2 | 0.02 |
| Gelatin | 1.04 |
| 3rd layer: First red-sensitive emulsion layer | |
| AgBrI emulsion (AgI: 6 mol %; average grain size: 0.8μ) | 0.55 (silver) |
| Sensitizing dye (I-25) | $6.9 \times 10^{-5}$ |
| Sensitizing dye (I-9) | $1.8 \times 10^{-5}$ |
| Sensitizing dye (I-10) | $3.1 \times 10^{-4}$ |
| Sensitizing dye (XX) | $4.0 \times 10^{-5}$ |
| EX-2 | 0.350 |
| HBS-1 | 0.005 |
| EX-11 | 0.015 |
| Gelatin | 1.20 |
| 4th layer: Second red-sensitive emulsion layer | |
| AgBrI emulsion (AgI: 8 mol %; average grain size: 0.85μ) | 1.20 (silver) |
| Sensitizing dye (I-25) | $5.1 \times 10^{-5}$ |
| Sensitizing dye (I-9) | $1.4 \times 10^{-5}$ |
| Sensitizing dye (I-10) | $2.3 \times 10^{-4}$ |

-continued

| | |
|---|---|
| Sensitizing dye (XX) | $3.0 \times 10^{-5}$ |
| EX-2 | 0.300 |
| EX-3 | 0.050 |
| EX-4 | 0.050 |
| EX-10 | 0.004 |
| HBS-1 | 0.050 |
| Gelatin | 1.30 |
| 5th layer: Third red-sensitive emulsion layer | |
| AgBrI emulsion (AgI: 14 mol %; average grain size: 1.5μ) | 1.60 (silver) |
| Sensitizing dye (I-30) | $5.4 \times 10^{-5}$ |
| Sensitizing dye (I-9) | $1.4 \times 10^{-5}$ |
| Sensitizing dye (I-10) | $2.4 \times 10^{-4}$ |
| Sensitizing dye (XX) | $3.1 \times 10^{-5}$ |
| EX-5 | 0.215 |
| EX-3 | 0.055 |
| EX-10 | 0.005 |
| HBS-1 | 0.32 |
| Gelatin | 1.63 |
| 6th layer: Interlayer | |
| Gelatin | 1.06 |
| 7th layer: First green-sensitive emulsion layer | |
| AgBrI emulsion (AgI: 6 mol %; average grain size: 0.8μ) | 0.40 (silver) |
| Sensitizing dye (I-3) | $3.0 \times 10^{-5}$ |
| Sensitizing dye (I-27) | $1.0 \times 10^{-4}$ |
| Sensitizing dye (I-28) | $3.8 \times 10^{-4}$ |
| EX-6 | 0.260 |
| EX-1 | 0.021 |
| EX-7 | 0.030 |
| EX-8 | 0.025 |
| HBS-1 | 0.100 |
| Gelatin | 0.75 |
| 8th layer: Second green-sensitive emulsion layer | |
| AgBrI emulsion (AgI: 9 mol %; average grain size: 0.85μ) | 0.80 (silver) |
| Sensitizing dye (I-3) | $2.1 \times 10^{-5}$ |
| Sensitizing dye (I-27) | $7.0 \times 10^{-5}$ |
| Sensitizing dye (I-31) | $2.6 \times 10^{-4}$ |
| EX-6 | 0.150 |
| EX-8 | 0.010 |
| EX-1 | 0.008 |
| EX-7 | 0.012 |
| HBS-1 | 0.60 |
| Gelatin | 1.10 |
| 9th layer: Third green-sensitive emulsion layer | |
| AgBrI emulsion (AgI: 12 mol %; average grain size: 1.3μ) | 1.2 (silver) |
| Sensitizing dye (I-3) | $3.5 \times 10^{-5}$ |
| Sensitizing dye (I-27) | $8.0 \times 10^{-5}$ |
| Sensitizing dye (I-28) | $3.0 \times 10^{-4}$ |
| EX-12 | 0.065 |
| EX-1 | 0.025 |
| HBS-2 | 0.55 |
| Gelatin | 1.74 |
| 10th layer: Yellow filter layer | |
| Yellow colloidal silver | 0.05 (silver) |
| 2,5-Di-t-pentadecylhydroquinone | 0.03 |
| Gelatin | 0.95 |
| 11th layer: First blue-sensitive emulsion layer | |
| AgBrI emulsion (AgI: 6 mol %; average grain size: 0.6μ) | 0.24 (silver) |
| Sensitizing dye (I-29) | $3.5 \times 10^{-4}$ |
| EX-9 | 0.85 |
| EX-8 | 0.12 |
| HBS-1 | 0.28 |
| Gelatin | 1.28 |
| 12th layer: Second blue-sensitive emulsion layer | |
| AgBrI emulsion (AgI: 10 mol %; average grain size: 1.0μ) | 0.45 (silver) |
| Sensitizing dye (I-29) | $2.1 \times 10^{-4}$ |
| EX-9 | 0.20 |
| EX-10 | 0.015 |
| HBS-1 | 0.03 |
| Gelatin | 0.46 |
| 13th layer: Third blue-sensitive emulsion layer | |
| AgBrI emulsion (AgI: 10 mol %; average grain size: 1.8μ) | 0.77 (silver) |
| Sensitizing dye (I-32) | $1.1 \times 10^{-4}$ |
| Sensitizing dye (I-33) | $1.1 \times 10^{-4}$ |

-continued

| | |
|---|---|
| EX-9 | 0.20 |
| HBS-1 | 0.07 |
| Gelatin | 0.69 |
| 14th layer: First protective layer | |
| AgBrI emulsion (AgI: 1 mol %; average grain size: 0.07μ) | 0.5 (silver) |
| U-1 | 0.11 |
| U-2 | 0.17 |
| HBS-1 | 0.90 |
| Gelatin | 1.00 |
| 15th layer: Second protective layer | |
| Polymethylacrylate particles (diameter: about 1.5 μm) | 0.54 |
| S-1 | 0.05 |
| S-2 | 0.20 |
| Gelatin | 0.72 |

In addition to the above-described ingredients, a gelatin hardener of H-1, a stabilizer of S-3, and a surfactant were added to each of the layers.

Chemical structural formulae or chemical names of the compounds used in the present invention are shown hereinafter.

(Samples 102 to 107)

Samples 102 to 107 were prepared in the same manner as Sample 101 except for incorporating the compounds of the present invention as shown in Table 4-1.

These samples were exposed for 1/100 second to a light source of 4800° K. in color temperature, developed according to the following processing, then subjected to measurement of density using a densitometer made by Fuji Photo Film Co., Ltd. to determine sensitivity and fog. The standard point for determining sensitivity was a point of (fog+0.2) in density.

Color development processing was conducted at 38° C. according to the following processing.

| | |
|---|---|
| Color development | 3'15" |
| Bleaching | 6'30" |
| Washing with water | 2'10" |
| Fixing | 4'20" |
| Washing with water | 3'15" |
| Stabilizing | 1'05" |

Formulations of the processing solutions used in respective steps are as follows.

| Color developer | |
|---|---|
| Diethylenetriaminepentaacetic acid | 1.0 g |
| 1-Hydroxyethylidene-1,1-diphosphonic acid | 2.0 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N—Ethyll-N—β-hydroxyethylamino)-2-methylaniline sulfate | 4.5 g |
| Water to make | 1.0 liter |
| pH | 10.0 |
| Bleaching solution | |
| Ammonium ethylenediamine-tetraacetato ferrate | 100.0 g |
| Disodium ethylenediaminetetra-acetate | 10.0 g |
| Ammonium bromide | 150.0 g |
| Ammonium nitrate | 10.0 g |
| Water to make | 1.0 liter |
| pH | 6.0 |
| Fixing solution | |

-continued

| Color developer | |
|---|---|
| Disodium ethylenediaminetetraacetate | 1.0 g |
| Sodium sulfite | 4.0 g |
| Ammonium thiosulfate aqeous solution (70%) | 175.0 ml |
| Sodium bisulfite | 4.6 g |
| Water to make | 1.0 liter |
| pH | 6.6 |
| Stabilizing solution | |
| Formalin (40%) | 2.0 ml |
| Polyoxyetylene-p-monononylphenyl ether (average polymerization degree: 10) | 0.3 g |
| Water to make | 1.0 liter |

TABLE 4-1

| Test No. | Compound of the Invention: Added Layer | Alkali Metal Sulfite ($\times 10^{-3}$ mol/mol Ag) | Ascorbic Acid Compound ($\times 10^{-3}$ mol/mol Ag) | Photographic Sensitivity/Fog: Blue-sensitive Layer | Green-sensitive Layer | Red-sensitive Layer |
|---|---|---|---|---|---|---|
| 101 (Comparison) | — | — | — | 100/0.12 | 100/0.08 | 100/0.10 |
| 102 (Invention) | 4th layer | (A-1) 0.25 | (B-2) 0.25 | 100/0.12 | 100/0.08 | 115/0.11 |
| | 5th layer | (A-1) 0.15 | (B-2) 0.15 | | | |
| 103 (Invention) | 4th layer | (A-1) 0.75 | (B-2) 0.75 | 100/0.12 | 100/0.08 | 122/0.12 |
| | 5th layer | (A-1) 0.45 | (B-2) 0.45 | | | |
| 104 (Invention) | 8th layer | (A-1) 0.20 | (B-2) 0.20 | 100/0.12 | 108/0.08 | 100/0.10 |
| | 9th layer | (A-1) 0.15 | (B-2) 0.15 | | | |
| 105 (Invention) | 8th layer | (A-1) 0.50 | (B-2) 0.50 | 100/0.12 | 111/0.09 | 100/0.10 |
| | 9th layer | (A-1) 0.35 | (B-2) 0.35 | | | |
| 106 (Invention) | 12th layer | (A-1) 0.25 | (B-2) 0.25 | 108/0.13 | 100/0.08 | 100/0.10 |
| | 13th layer | (A-1) 0.15 | (B-2) 0.15 | | | |
| 107 (Invention) | 12th layer | (A-1) 0.30 | (B-2) 0.45 | 112/0.14 | 100/0.08 | 100/0.10 |
| | 13th layer | (A-1) 0.20 | (B-2) 0.30 | | | |

It is seen form the results shown in Table 4-1 that samples of the present invention wherein the alkali metal sulfite compound and the ascorbic acid compound are used in combination show a high sensitivity.

Photographic properties other than sensitivity, such as spectral sensitivity, graininess, sharpness, etc. are about the same.

Similar results were obtained by changing the developing steps as follows.

| | |
|---|---|
| Color development | 3'15" |
| Bleaching | 1' |
| Bleach-fixing | 3'15" |
| Washing with water (1) | 40" |
| Washing with water (2) | 1' |
| Stabilizing | 40" |
| Drying (50° C.) | 1'15" |

In the above-described processing steps, washing (1) and washing (2) were conducted in a countercurrent washing manner of from (2) to (1). Formulations of respective processing solutions are shown below. Additionally, replenishing amounts of the processing solutions were as follows.

Replenishing amount of the color developer was 1200 ml per $m^2$ of color light-sensitive material, and that of other solutions including washing water were 800 ml per $m^2$ of color light-sensitive material. An amount of the processing solution introduced from a pre-bath to the washing step was 50 ml per $m^2$ of color light-sensitive material.

| | Mother Solution | Replenisher |
|---|---|---|
| Color developer: | | |
| Diethylenetriaminepenta-acetic acid | 1.0 g | 1.1 g |
| 1-Hydroxyethylidene-1,1-di-phosphonic acid | 2.0 g | 2.2 g |
| Sodium sulfite | 4.0 g | 4.4 g |
| Potassium carbonate | 30.0 g | 32.0 g |
| Potassium bromide | 1.4 g | 0.7 g |
| Potassium iodide | 1.3 mg | — |
| Hydroxylamine sulfate | 2.4 g | 2.6 g |
| 4-(N—Ethyl-N—β-hydroxyethyl-amino)-2-methylaniline sulfate | 4.5 g | 5.0 g |
| Water to make | 1.0 liter | 1.0 liter |
| pH | 10.0 | 10.05 |

Bleaching solution: Mother solution and replenisher had the same formulation.

| | |
|---|---|
| Ammonium ethylene-diaminetetraacetato ferrate | 120.0 g |
| Disodium ethylenediamine tetraacetate | 10.0 g |
| Ammonium nitrate | 10.0 g |
| Ammonium bromide | 100.0 g |
| Bleaching accelerator | $5 \times 10^{-3}$ mol |

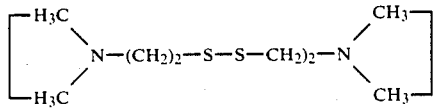

| | |
|---|---|
| Aqueous ammonia to make pH | 6.3 |
| Water to make | 1.0 liter |

Bleach-fixing solution: Mother solution and replenisher had the same formulation.

| | |
|---|---|
| Ammonium ethylenediamine-tetraacetato ferrate | 50.0 g |

-continued

| | |
|---|---|
| Disodium ethylenediamine-tetraacetate | 5.0 g |
| Sodium sulfite | 12.0 g |
| Ammonium thiosulfate aqueous solution (70%) | 240.0 ml |
| Aqueous ammonia to adjust pH to | 7.3 |
| Water to make | 1.0 liter |
| Washing water: | Mother solution and replenisher had the same formulation. |

City water containing 32 mg/liter of calcium ion and 7.3 mg/liter of magnesium ion was passed through a column filled with a H-type strongly acidic cation exchange resin and a OH-type strongly basic anion exchange resin to reduce the calcium ion level and the magnesium ion level to 1.2 mg/liter and 0.4 mg/liter, respectively. To the thus processed water was added 20 mg/liter of sodium dichloroisocyanurate.

| Stabilizing solution: Mother solution and replenisher had the same formulation | |
|---|---|
| Formalin (37% w/v) | 2.0 ml |
| Polyoxyethylene-p-mono-nonylphenyl ether (average polymerization degree: 10) | 0.3 g |
| Disodium ethylenediamine-tetraacetate | 0.05 g |
| Water to make | 1 liter |
| pH | 5.8 |
| Drying | |
| Drying temperature was 50° C. | |

Structural formulae or chemical names of the compounds used in Example 4:

U-1

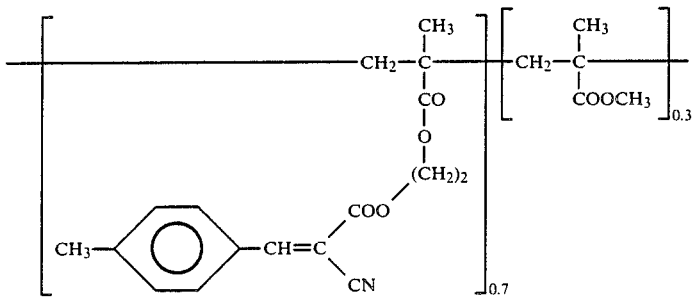

U-2

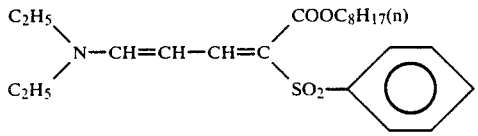

Ex-1

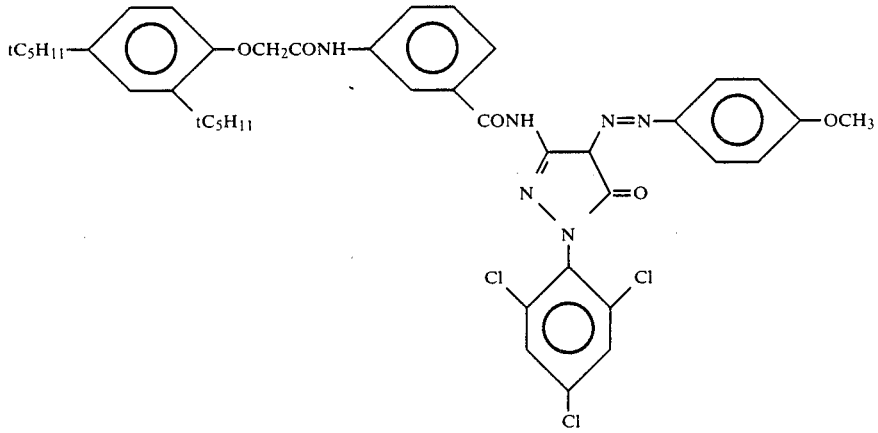

Ex-2

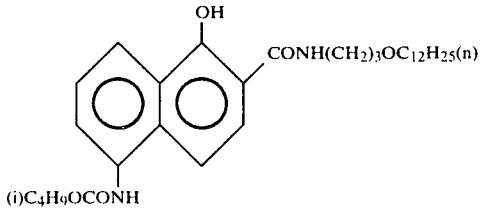

-continued
Ex-3
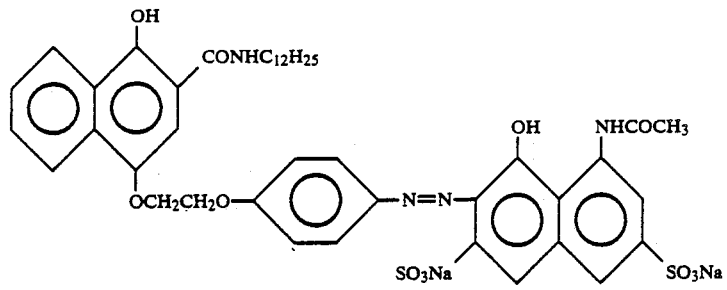
Ex-4
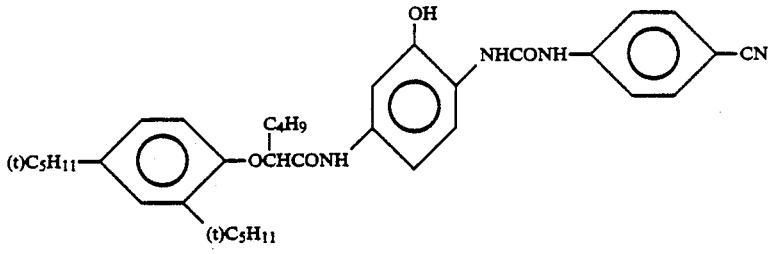
Ex-5
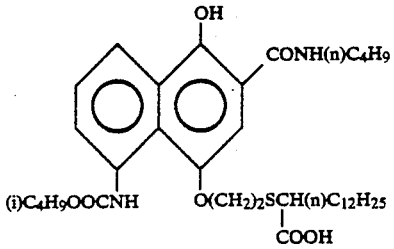
Ex-6
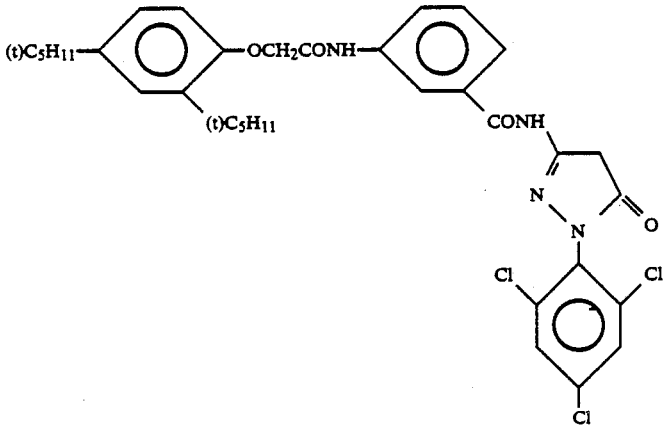
Ex-7
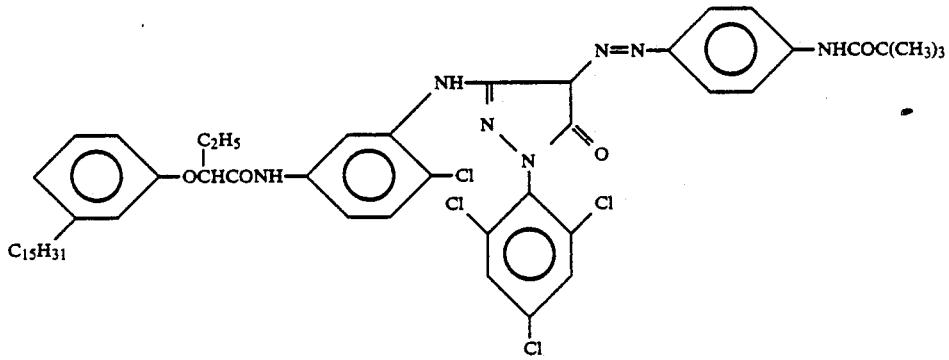

-continued
Ex-8
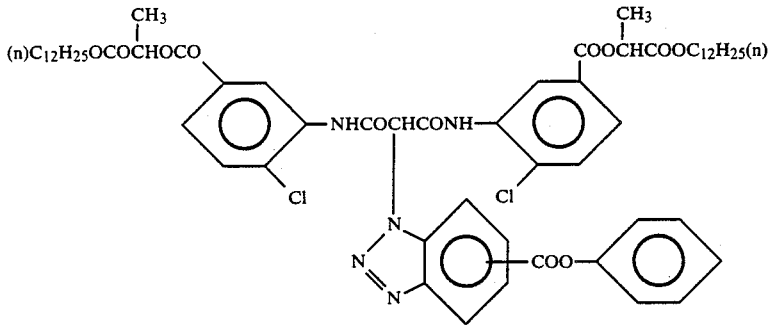
Ex-9
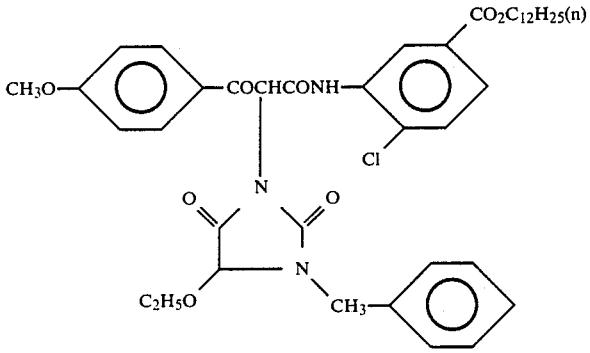
Ex-10
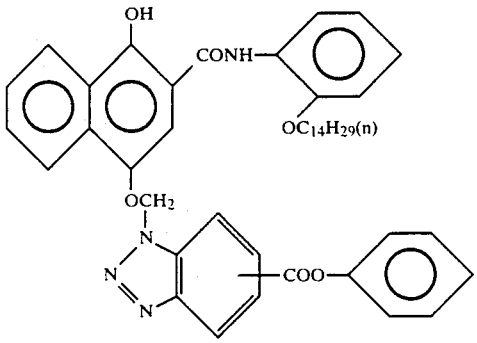
Ex-11
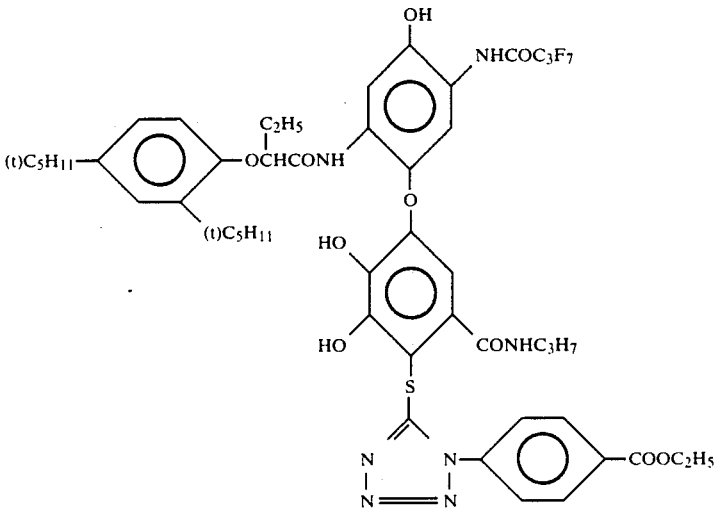

-continued

Ex-12

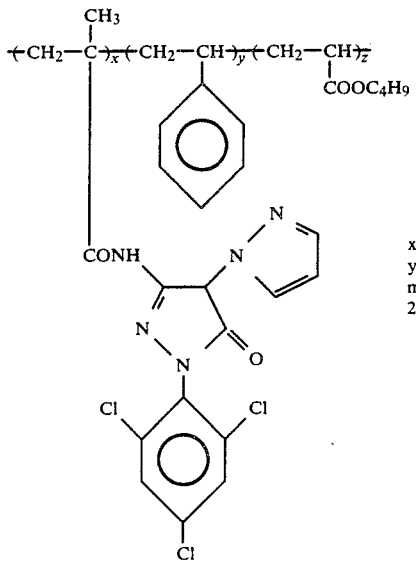

x/y + z = 1
y/z = 1
molecular weight = 20000 to 80000

Tricresyl phosphate HBS-1
Dibutyl phthalate HBS-2

H-1

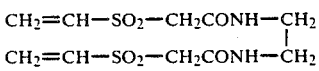

S-1

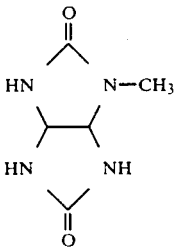

S-2

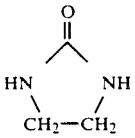

S-3

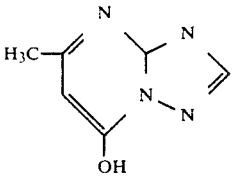

XX

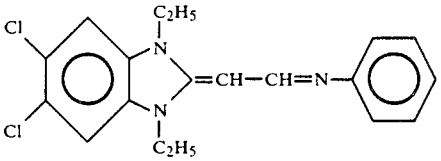

While the present invention has been described in detail and with reference to specific embodiments thereof, it is apparent to one skilled in the art that various changes and modifications can be made therein without departing from the spirit and the scope of the present invention.

What is claimed is:

1. A spectrally sensitized silver halide photographic emulsion comprising at least one alkali metal sulfite compound and at least one ascorbic acid compound as supersentizing agents for a spectrally sensitizing dye wherein the spectrally sensitizing dye is selected from the group consisting of a cyanine dye, a merocyanine dye and a complex cyanine dye of these dyes and wherein the molar ratio of said alkali metal sulfite compound to said ascorbic acid compound is 20:1 to 1:20.

2. The spectrally sensitized silver halide photographic emulsion as claimed in claim 1 wherein the sum of the two compounds is $2\times10^{-4}$ mol to $4\times10^{-2}$ mol per mol of silver with respect to silver chloride emulsions, silver bromide emulsions, silver chlorobromide emulsions, and silver chlorobromoiodide emulsions containing up to 1 mol % iodide.

3. The spectrally sensitized silver halide photographic emulsion as claimed in claim 1 wherein the sum of the two compounds is $2\times10^{-5}$ mol to $4\times10^{-3}$ mol per mol of silver with respect to silver bromoiodide emulsions.

4. The spectrally sensitized silver halide photographic emulsion as claimed in claim 1, wherein the sensitizing dye has a sensitizing maximum wavelength of longer than 600 nm.

5. The spectrally sensitized silver halide photographic emulsion as claimed in claim 1 wherein said alkali metal sulfite compound and ascorbic acid compound are incorporated each in an amount of $1\times10^{-6}$ mol to $5\times10^{-2}$ mol per mol of silver halide.

6. The spectrally sensitized silver halide photographic emulsion as claimed in claim 1 wherein said alkali metal sulfite compound and ascorbic acid compound are incorporated each in an amount of $1\times10^{-6}$ mol to $5\times10^{-2}$ mol per mol of silver halide.

7. The spectrally sensitized silver halide photographic emulsion as claimed in claim 1 wherein the spectrally sensitizing dye is incorporated in an amount of from $5\times10^{-7}$ mol to $5\times10^{-3}$ mol per mol of silver halide.

8. The spectrally sensitized silver halide photographic emulsion as claimed in claim 1 wherein said alkali metal sulfite compound is selected from the group consisting of sodium sulfite, potassium sulfite, sodium hydrogensulfite, and potassium hydrogensulfite.

9. The spectrally sensitized silver halide photographic emulsion as claimed in claim 1 wherein said ascorbic acid compound is selected from the group consisting of L-ascorbic acid, sodium L-ascorbate, potassium L-ascorbate, DL-ascorbic acid, sodium D-ascorbate, L-ascorbic acid-6-acetate, L-ascorbic acid-6-palmitate, L-ascorbic acid-6-benzoate, L-ascorbic acid-6-diacetate, and L-ascorbic acid-5,6-O-isopropylidene.

10. The spectrally sensitized silver halide photographic emulsion as claimed in claim 8 wherein said alkali metal sulfite compound is sodium sulfite or potassium sulfite.

* * * * *